US007680436B2

(12) United States Patent
Hayakawa

(10) Patent No.: US 7,680,436 B2
(45) Date of Patent: Mar. 16, 2010

(54) DEVELOPING UNIT COMPRISING MOVEMENT MEMBER CAPABLE OF MOVING BETWEEN HOUSING POSITION AND PROTRUDING POSITION AND IMAGE FORMING DEVICE

(75) Inventor: Atsushi Hayakawa, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 537 days.

(21) Appl. No.: 11/644,952

(22) Filed: Dec. 26, 2006

(65) Prior Publication Data

US 2007/0147890 A1 Jun. 28, 2007

(30) Foreign Application Priority Data

Dec. 27, 2005 (JP) ..... 2005-373792

(51) Int. Cl.
*G03G 15/08* (2006.01)

(52) U.S. Cl. ..... 399/119

(58) Field of Classification Search ..... 399/119, 399/110, 113, 107, 111
See application file for complete search history.

(56) References Cited

U.S. PATENT DOCUMENTS 4,583,832 A * 4/1986 Kasamura et al. ..... 399/119
5,845,176 A 12/1998 Yoshida et al.
RE36,301 E * 9/1999 Kai et al. ..... 399/113
6,751,428 B2 6/2004 Okabe
2004/0265000 A1 12/2004 Okabe
2006/0029421 A1 * 2/2006 Ishii et al. ..... 399/111

FOREIGN PATENT DOCUMENTS

JP 8-69143 3/1996
JP 2001-281949 10/2001
JP 2002-6606 1/2002

* cited by examiner

*Primary Examiner*—David M Gray
*Assistant Examiner*—Billy J Lactaoen
(74) *Attorney, Agent, or Firm*—Banner & Witcoff, Ltd.

(57) ABSTRACT

A developing unit is to be attachable to and detachable from an image forming device main body. The developing unit is provided with a developer case, a developing roller coupled with the developer case, and a movement member coupled with the developer case. The movement member is capable of moving between a housing position where the movement member is substantially housed inside the developer case and a protruding position where the movement member protrudes beyond the developer case. The movement member is positioned at the protruding position and pushed by the image forming device main body in a predetermined direction while the developing unit is being attached to the image forming device main body.

18 Claims, 14 Drawing Sheets

DEVELOPING UNIT COMPRISING MOVEMENT MEMBER CAPABLE OF MOVING BETWEEN HOUSING POSITION AND PROTRUDING POSITION AND IMAGE FORMING DEVICE

CROSS-REFERENCE TO RELATED APPLICATION

This application claims priority to Japanese Patent Application No. 2005-373792, filed on Dec. 27, 2005, the contents of which are hereby incorporated by reference into the present application.

BACKGROUND OF THE INVENTION

1. Field of the Invention

The present invention relates to an image forming device for forming images using developer. Further, the present invention relates to a developing unit of the image forming device. Moreover, the present invention also relates to an image forming device main body attached to the developing unit.

2. Description of the Related Art

Image forming devices that utilize developer to print onto a recording medium (printing paper, for example) are well known. For example, a laser printer comprises a laser printer main body, and a developing unit attached detachably thereto.

The laser printer main body has a main case including a space for housing the developing unit, and a photoreceptor disposed in a position facing the space. The photoreceptor supports an electrostatic latent image.

The developing unit has a case for housing toner, and a developing roller supported rotatably by the toner case. While the developing unit is attached to the laser printer main body, the photoreceptor and the developing roller both rotate while making contact with one another. The developing roller supplies toner housed in the toner case to the photoreceptor. The toner thus adheres to an area of the photoreceptor on which the electrostatic latent image is formed, and the electrostatic latent image of the photoreceptor becomes visible. The toner that has become visible is transferred from the photoreceptor to the recording medium, thus forming words or images on the recording medium.

In order to form a visible image having a uniform thickness on the photoreceptor, it is preferred that the developing roller presses the photoreceptor with a constant amount of force. For this purpose, a pushing member may be formed on the laser printer main body. This pushing member pushes the toner case in a direction where the developing roller presses the photoreceptor.

Further, a laser printer that performs color printing using four colors of toner is provided with four photoreceptors and four developing units. Each of the developing units houses a different color toner. When the photoreceptors and the developing rollers of the developing units have been brought into contact, the different color toners are supplied to the photoreceptors. Color printing can thus be performed. Alternatively, in the case where monochromatic printing is performed, toner may be supplied to only one photoreceptor. The developing roller may therefore be brought into contact with only the relevant photoreceptor, and the other developing rollers may be separate from the other three photoreceptors. In order to realize this operation, the laser printer main body may be provided with a pushing member. This pushing member pushes the toner case in a direction where the developing rollers separate from the photoreceptors.

U.S. Pat. No. 6,751,428 teaches a developing unit having a protruding member that protrudes from a toner case. The protruding member is fixed to the toner case. With this developing unit, a developing roller is pressed against a photoreceptor by the protruding member being pushed from a laser printer main body.

BRIEF SUMMARY OF THE INVENTION

The portion protruding from the developer case (the toner case in the above example) can be broken off or bent more easily than other parts. The protruding portion could be damaged if strong force is applied unexpectedly to the protruding portion of the developing unit while this developing unit is not attached to the image forming device main body (the laser printer main body in the above example).

The present invention has taken the above problem into consideration, and aims to present a developing unit that cannot easily be damaged.

The present specification teaches a developing unit to be attachable to and detachable from an image forming device main body. The developing unit comprises a developer case, a developing roller, and a movement member. The developer case accommodates a developer. The developing roller is coupled with the developer case. The developing roller supplies the developer accommodated in the developer case to a photoreceptor. The movement member is coupled with the developer case. The movement member is capable of moving between a housing position where the movement member is substantially housed inside the developer case and a protruding position where the movement member protrudes beyond the developer case.

The movement member is positioned in the protruding position and is pushed by the image forming device main body in a predetermined direction while the developing unit is being attached to the image forming device main body.

This developing unit can be moved between a movement member housing position and a movement member protruding position. When the developing unit is in an attached state with respect to the image forming device main body, the movement member protrudes from the developer case. As a result, the movement member (i.e. the developing unit) can be pushed in the predetermined direction. When the developing unit is not in an attached state with respect to the image forming device main body, the movement member can be maintained in the housing position. As a result, the phenomenon can be prevented wherein strong force is applied unexpectedly to the movement member. With this developing unit, damage to the movement member can be prevented.

BRIEF DESCRIPTION OF THE DRAWINGS

FIG. 7 shows a process, over time, of attaching the developing unit to the drum unit main body.

FIG. 15 shows a process, over time, of separating the developing roller from the photoreceptor.

In FIG. 15B, the movement members are positioned between the housing position and the protruding position. In FIG. 15C, the movement members are positioned at the protruding position.

DETAILED DESCRIPTION OF THE INVENTION

Figure 1:
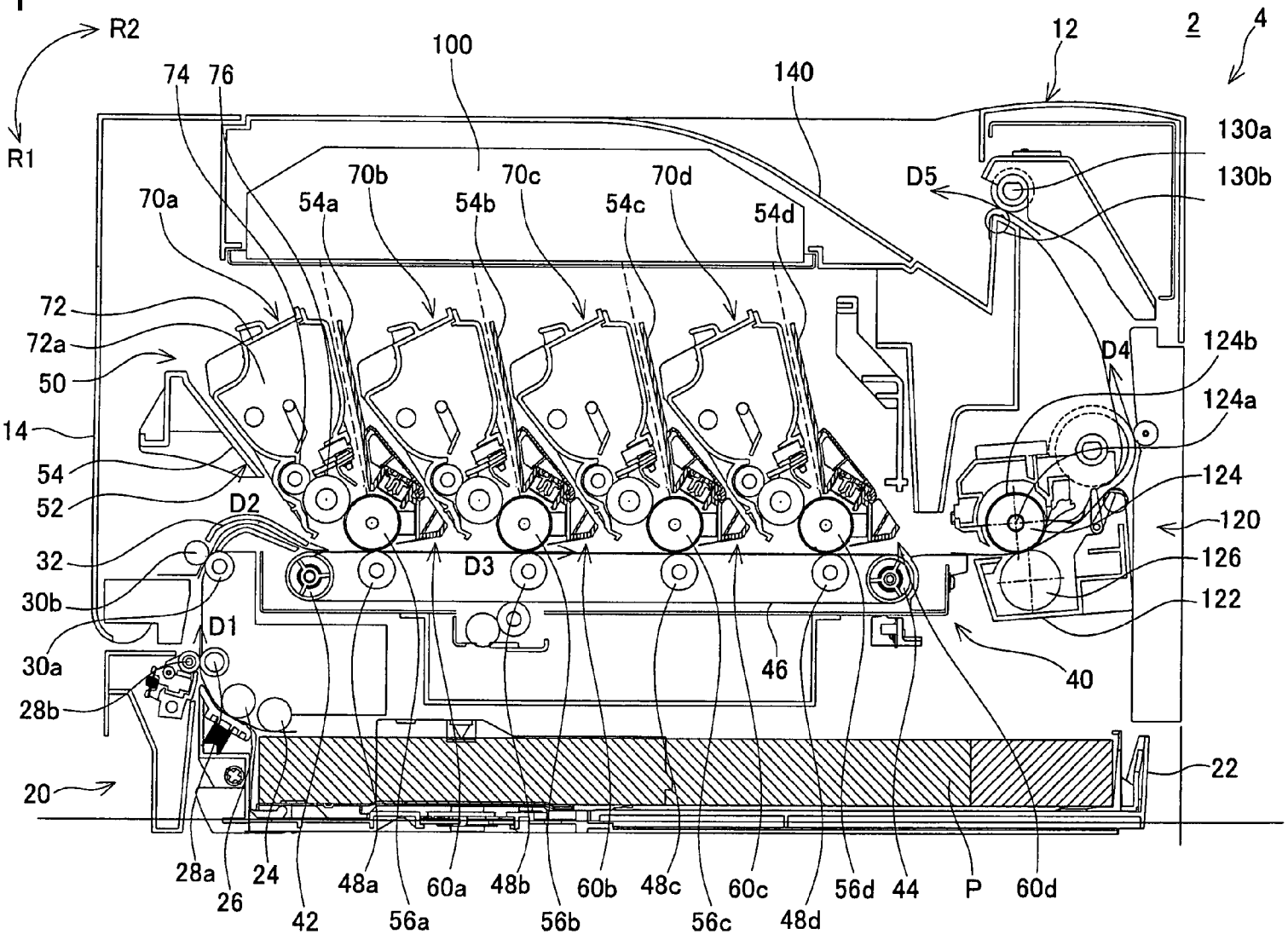
FIG. 1 shows a cross-sectional view of a laser printer of the present embodiment.

Main characteristics of the art set forth in the embodiments are listed below.

(1) A pair of movement members may be formed on the developer case. A first of the movement members may be coupled with a first end side of the developer case, and the second of the movement members may be coupled with the other end side of the developer case. The first movement member and the second movement member may protrude in opposing directions.

(2) The developer case may include an opening. The developing roller may be disposed in a position facing this opening.

(3) A gear may be formed at one end of the developing roller. A collar member that covers an axis of the developing roller may be formed at an outer side surface of the developer case. The movement member that is in a protruding position may protrude from this outer side surface. That is, the movement member that is in the protruding position and the collar member of the developing roller may be exposed at the same outer side surface.

(4) The developing unit may include a supply roller that makes contact with the developing roller. The supply roller may be disposed further inwards in the developer case than the developing roller. The supply roller may supply developer housed in the developer case to the developing roller.

(5) The image forming device may include a drum unit. The drum unit may include a drum unit main body having a photoreceptor, and a developing unit attached detachably to the drum unit main body.

The image forming device main body may include a main case, and the drum unit main body capable of being housed removably within the main case. The developing unit may be attached to or removed from the drum unit main body while the drum unit main body is outside the main case.

(6) The photoreceptor may be supported in a manner allowing rotation within the drum unit main body. The rotational axis of the photoreceptor may extend in the same direction as the rotational axis of the developing roller.

(7) The image forming device may include a plurality of pairs of photoreceptors and developing units. Each developing unit houses a different color developer. This image forming device is capable of performing color printing.

(8) In the case where color printing is performed, the developing rollers of the developing units make contact with the photoreceptors. In the case where monochromatic printing is performed, the developing roller of one developing unit makes contact with one photoreceptor, and the remaining developing rollers of the developing units are separate from the photoreceptors. The movement members push the developing rollers in a direction of separation from the photoreceptors in order to realize the separation operation.

(9) The image forming device may include a first pushing member for pushing the movement member in a direction where the developing roller presses the photoreceptor, and a second pushing member for pushing the movement member in a direction where the developing roller separates from the photoreceptor. The first pushing member may push a first area of the movement member. The second pushing member may push a second area of the movement member. In this case, it is preferred that the first area and the second area are different.

Moreover, it is preferred that the first area is disposed in a position close to the developer case, and that the second area is disposed in a position far from the developer case. When the first area is disposed in a position close to the developer case, the pushing force for pressing the developing roller against the photoreceptor can be applied to a position close to the developer case. In this case, since the pushing force can be applied to a position close to the developing roller, the developing roller can be pressed against the photoreceptor successfully. When the second area is disposed in a position far from the developer case, the first area and the second area can be disposed in different positions.

First Embodiment

A laser printer 2 of the present embodiment will be described with reference to the figures. FIG. 1 shows a cross-sectional view of the laser printer 2. Below, the laser printer 2 may be referred to simply as the printer 2. In the present embodiment, the left direction of FIG. 1 is the front side of the printer 2.

The printer 2 has a printer main body 4, and developing units 70*a*, 70*b*, 70*c*, and 70*d* attached detachably to the printer main body 4. The printer main body 4 has a main case 12. The main case 12 includes a plurality of plate-shaped members. In FIG. 1, a front side cover member 14 is shown that constitutes a part of the main case 12. The front side cover member 14 can swing in the directions shown by the arrows R1 and R2. Swinging the front side cover member 14 in the direction of the arrow R1 opens the main case 12. In this state, a drum unit 50 (to be described) can be removed from the main case 12. Swinging the front side cover member 14 in the direction of the arrow R2 closes the main case 12.

The printer main body 4 has a paper supply device 20, a belt unit 40, a drum unit main body 52, an exposure device 100, a toner fixing device 120, etc. These devices 20, 40, 52, 100, and 120 are disposed within the main case 12. The devices 20, 40, 52, 100, and 120 will be described in sequence below.

The paper supply device 20 includes a paper supply tray 22, and rollers 24, 26, 28*a*, 28*b*, 30*a*, 30*b*, etc. The paper supply tray 22 can be inserted into and removed from a front surface side (the left side in FIG. 1) of the main case 12. The paper supply tray 22 can house a plurality of sheets of printing paper P in a stacked state. The uppermost sheet of printing paper P housed in the paper supply tray 22 makes contact with the roller 24. When the paper supply roller 24 rotates, the uppermost sheet of printing paper P housed in the paper supply tray 22 is transported toward the left. The sheet of printing paper P that has been transported toward the left is transported upward (in the direction of the arrow D1) by the roller 26 and the pair of rollers 28*a* and 28*b*. The printing paper P that has been transported in the direction of the arrow D1 passes between the pair of rollers 30*a* and 30*b*. The printing paper P is transported by the rotation of the pair of rollers 30*a* and 30*b* toward the right along a rail 32 (in the direction of the arrow D2). The printing paper P is thus disposed on the belt unit 40.

The belt unit 40 includes a pair of rollers 42 and 44, and a belt 46. The roller 42 is disposed at a front surface side (the left side in FIG. 1). The other roller 44 is disposed at a back surface side (the right side in FIG. 1). The belt 46 is suspended between the pair of rollers 42 and 44. When the roller 42 rotates in a clockwise direction, the other roller 44 follows this rotation. When the pair of rollers 42 and 44 rotates in a clockwise direction, the belt 46 rotates in a clockwise direction. The printing paper P that has been transported in the direction of the arrow D2 is disposed on a top surface of the belt 46. The printing paper P that is disposed on the top surface of the belt 46 is transported toward the right by the rotation of the belt 46 (in the direction of the arrow D3).

Words or images are printed on the printing paper P while this is being transported in the direction of the arrow D3. Specifically, the printing paper P is printed by transfer rollers 48*a* to 48*d*, the drum unit 50, and the exposure device 100.

The four transfer rollers 48*a* to 48*d* are disposed at an inner side of the belt 46. The transfer rollers 48*a* to 48*d* make contact with an inner surface of the belt 46 at an upper side thereof.

The drum unit 50 has the drum unit main body 52 and the four developing units 70*a*, 70*b*, 70*c*, and 70*d*. The drum unit 50 is housed removably within the main case 12. The drum unit 50 can be removed from the main case 12 by opening the front side cover member 14 (in the direction of the arrow R1), and sliding the drum unit 50 toward the left with respect to FIG. 1. A detailed description of the external configuration of the drum unit 50 will be given later. Here, a brief description of the configuration thereof will be given.

The four developing units 70*a*, 70*b*, 70*c*, and 70*d* can be housed removably within the drum unit main body 52. The drum unit main body 52 includes a drum case 54, four photoreceptors 56*a*, 56*b*, 56*c*, and 56*d*, four chargers 60*a*, 60*b*, 60*c*, and 60*d*, etc. A left end of the drum case 54 is disposed further to the left than the roller 42 of the belt unit 40. A right end of the drum case 54 is disposed near the other roller 44 of the belt unit 40. The drum case 54 has separating plates 54*a*, 54*b*, 54*c*, and 54*d* extending in the up-down direction of FIG. 1. The separating plates 54*a* to 54*d* divide the drum case 54 into four chambers 61*a* to 61*d* (not numbered in FIG. 1, but shown in FIG. 3). The developing units 70*a* to 70*d* are housed within the chambers 61*a* to 61*d* respectively.

The photoreceptors 56*a* to 56*d* are attached in a manner allowing its rotation to the drum case 54. The photoreceptor 56*a* faces the transfer roller 48*a* via the belt 46. Similarly, the remaining photoreceptors 56*b* to 56*d* face the corresponding transfer rollers 48*b* to 48*d*. The printing paper P that has been transferred in the direction of the arrow D3 passes between the photoreceptors 56*a* to 56*d* and the transfer rollers 48*a* to 48*d*. Bias voltage is applied to the transfer rollers 48*a* to 48*d* during this process. Toner supported on the photoreceptors 56*a* to 56*d* is thus transferred to the printing paper P.

The chargers 60*a* to 60*d* are fixed to the drum case 54. The charger 60*a* faces the photoreceptor 56*a*. Similarly, the remaining chargers 60*b* to 60*d* face the corresponding photoreceptors 56*b* to 56*d*. The chargers 60*a* to 60*d* positively charge a surface of the photoreceptors 56*a* to 56*d* by means of corona discharge.

The developing units 70*a* to 70*d* are detachably attached to the drum unit main body 52. The developing unit 70*a* has a toner case 72, a supply roller 74, a developing roller 76, etc. A toner chamber 72*a* is formed within the toner case 72. Yellow toner is housed within the toner chamber 72*a* of the developing unit 70*a*. The supply roller 74 and the developing roller 76 are attached in a manner allowing its rotation to the toner case 72. The supply roller 74 is disposed in a position facing the toner chamber 72*a*. The developing roller 76 makes contact with the supply roller 74. The developing roller 76 also makes contact with the photoreceptor 56*a*.

The remaining developing units 70*b* to 70*d* have the same configuration as the developing unit 70*a*. In FIG. 1, the reference numbers have been omitted of the compositional elements of the remaining developing units 70*b* to 70*d* (i.e. the toner case, the toner chamber, the supply roller, the developing roller, etc.). Magenta toner is housed within the toner chamber of the developing unit 70*b*. Cyan toner is housed within the toner chamber of the developing unit 70*c*. Black toner is housed within the toner chamber of the developing unit 70*d*. The printer 2 of the present embodiment performs color printing on the printing paper P utilizing the four colors of toner.

The exposure device 100 is disposed above the drum unit 50. The exposure device 100 is fixed to the main case 12. The exposure device 100 has a light source (not shown). A laser beam is emitted from the light source. The laser beam supplied from the light source reaches the photoreceptors 56*a* to 56*d* of the drum unit 50. In FIG. 1, the path of a laser beam irradiated from the exposure device 100 is shown by a broken line. The paths are shown of four laser beams for exposing the four photoreceptors 56*a* to 56*d*. The laser beams pass between the developing units 70*a* to 70*d* and the separating plates 54*a* to 54*d*. A predetermined pattern is exposed on the photoreceptors 56*a* to 56*d* by irradiating the photoreceptors 56*a* to 56*d* with the laser beams.

Operations until the toner is transferred to the printing paper P will be described. The toner in the toner chamber 72*a* adheres to the supply roller 74. The toner adhering to the supply roller 74 is positively charged by friction between the supply roller 74 and the developing roller 76. The positively charged toner covers a surface of the developing roller 76.

Surfaces of the photoreceptors 56*a* to 56*d* are positively charged by the chargers 60*a* to 60*d*. The positively charged photoreceptors 56*a* to 56*d* receive the light of the laser beams emitted from the exposure device 100. A predetermined part of the surfaces of the photoreceptors 56*a* to 56*d* is thus exposed. There is a fall in the potential of the exposed parts of the photoreceptors 56*a* to 56*d*. The parts that are exposed vary in accordance with the content to be printed. Electrostatic latent images are formed on the photoreceptors 56*a* to 56*d* based on the content to be printed. The photoreceptors 56*a* to 56*d* thus support the electrostatic latent images.

The toner covering the developing rollers 76 adheres to the exposed parts of the photoreceptors 56*a* to 56*d*. The toner is thus supplied from the developing rollers 76 to the photoreceptors 56*a* to 56*d*. At this juncture, toner does not adhere to the non-exposed parts of the photoreceptors 56*a* to 56*d*. The electrostatic latent images formed on the photoreceptors 56*a* to 56*d* thus become visible.

The visible images supported on the photoreceptors 56*a* to 56*d* are transferred to the printing paper P being transported between the photoreceptors 56*a* to 56*d* and the transfer rollers 48*a* to 48*d*. In this process, a bias is applied to the transfer rollers 48*a* to 48*d*. The toner is transferred to the printing paper P due to the potential difference between the photoreceptors 56*a* to 56*d* and the transfer rollers 48*a* to 48*d*.

Desired images (words or images) are printed on the printing paper P by means of the above process.

Next, the configuration of the toner fixing device 120 will be described. The toner fixing device 120 is disposed to the rear side of the drum unit 50 (at the right side in FIG. 1). The toner fixing device 120 includes a frame 122, a heating roller 124, and a pressing roller 126. The heating roller 124 and the pressing roller 126 are supported by the frame 122 in a manner allowing its rotation.

The heating roller 124 has a halogen lamp 124*a* and a metal pipe 124*b*. The halogen lamp 124*a* heats the metal pipe 124*b*. The pressing roller 126 is pushed at a heating roller 124 side thereof by a mechanism (not shown).

The printing paper P that has been transported by the belt unit 40 enters between the heating roller 124 and the pressing roller 126. The printing paper P is heated by the heating roller 124 that has been heated to a high temperature. The toner that has been transferred to the printing paper P is thus fixed by the heat. The printing paper P that has passed through the toner fixing device 120 is transported toward a direction of the arrow D4.

A pair of rollers 130*a* and 130*b* is disposed above the toner fixing device 120. The rollers 130*a* and 130*b* transport the printing paper P that has passed through the toner fixing device 120 toward the left (in the direction of the arrow D5). The printing paper P is transported to the exterior of the main case 12. A paper tray 140 is formed at an upper surface of the main case 12. The printing paper P that has been transported to the exterior of the main case 12 is ejected onto the paper tray 140.

Figure 2:
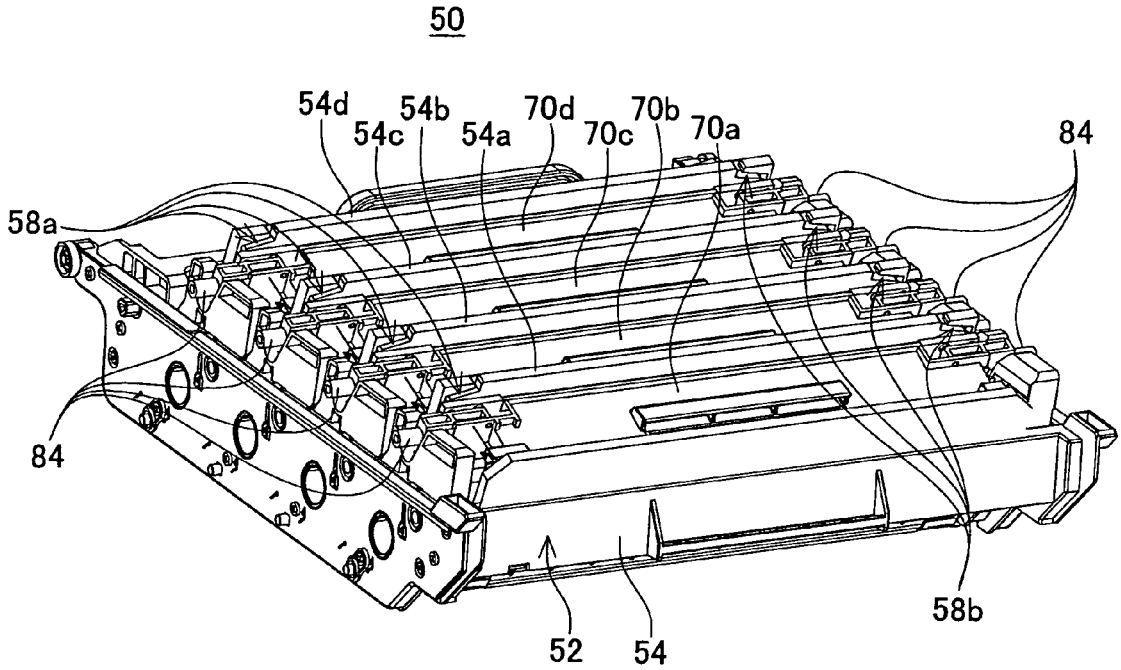
FIG. 2 shows a perspective view of a drum unit.

The configuration of the printer 2 has been described simply. The manner in which the printing paper P is transported within the main case 12 has been described. Next, the configuration of the drum unit 50 will be described in detail. FIG. 2 shows a perspective view of the drum unit 50. FIG. 2 shows a state where the developing units 70*a* to 70*d* are attached to the drum unit main body 52.

The drum unit 50 can be removed from the main case 12. The developing units 70*a* to 70*d* can be removed from or attached to the drum unit main body 52 when the drum unit 50 has been removed from the main case 12. In the present embodiment, it is possible to exchange only the developing units when the toner has run out. Further, in the present embodiment, the drum unit main body 52 can be exchanged when the photoreceptors 56*a* to 56*d* have become old.

Figure 3:
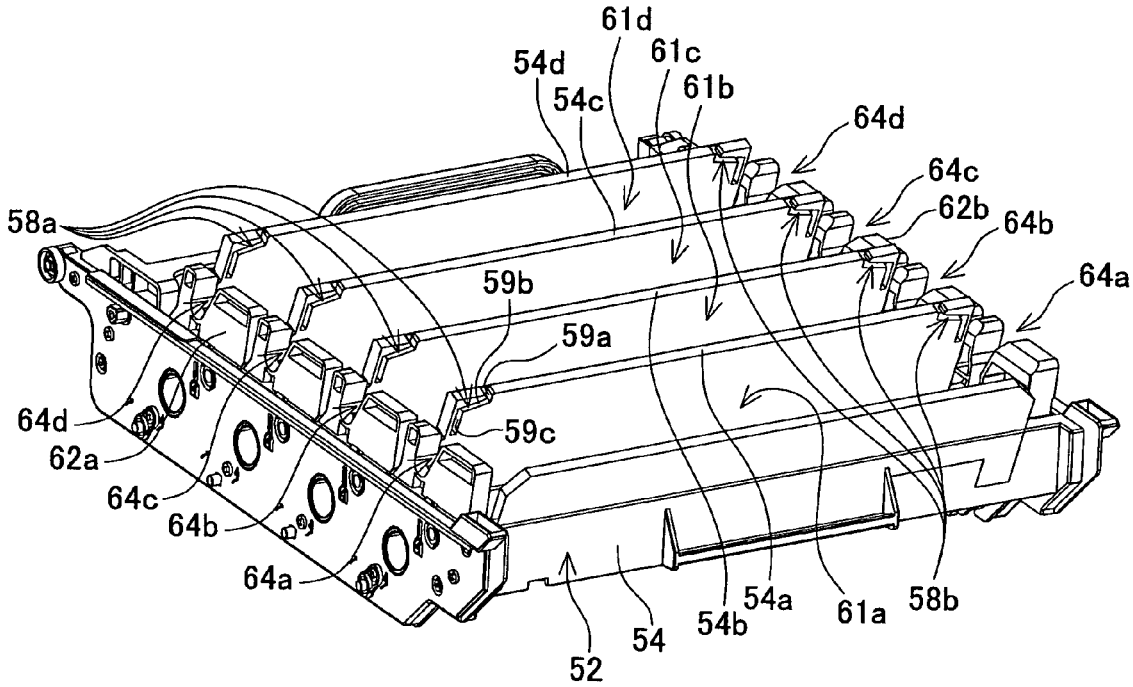
FIG. 3 shows a perspective view of a drum unit main body.

As shown in FIG. 2, the drum unit main body 52 has a substantially rectangular parallelepiped shape with an opening in the upper surface. The four separating plates 54*a* to 54*d* are formed in the drum unit main body 52. The spaces 61*a* to 61*d* (not numbered in FIG. 2, but shown in FIG. 3) for housing the developing units 70*a* to 70*d* are formed by the four separating plates 54*a* to 54*d*. FIG. 3 shows a perspective view of the drum unit main body 52 in a state where the developing units 70*a* to 70*d* have been removed. The manner in which the spaces 61*a* to 61*d* are formed can be seen clearly in FIG. 3.

A pair of grooves 58*a* and 58*b* is formed in each of the separating plates 54*a* to 54*d*. These grooves 58*a* and 58*b* each have a base. One groove 58*a* is formed at the left side with respect to FIGS. 2 and 3, and the other groove 58*b* is formed at the right side. As shown clearly in FIG. 3, the two grooves 58*a* and 58*b* formed in the one separating plate 54*a*, etc. have a configuration that is a mirror image in the left-right direction. As shown in FIG. 3, the groove 58*a* of the separating plate 54*a* includes a first part 59*a* extending downward from a top edge of the separating plate 54*a*, a second part 59*b* extending obliquely downward (the left downward direction in FIG. 3) from a bottom edge of the first part 59*a*, and a third part 59*c* extending downward from a bottom edge of the second part 59*b*. The other groove 58*b* of the separating plate 54*a* has a configuration that is a mirror image in the left-right direction of the groove 58*a*. That is, the other groove 58*b* also comprises a first part extending downward from the top edge of the separating plate 54*a*, a second part extending obliquely downward (the right downward direction in FIG. 3) from the bottom edge of the first part, and a third part extending downward from the bottom edge of the second part. Grooves 58*a* and 58*b* having the same configuration as in the separating plate 54*a* are also formed in the remaining separating plates 54*b* to 54*d*.

Four notches 64*a*, 64*b*, 64*c*, and 64*d* are formed in a left side wall 62*a* of the drum unit main body 52. The notches 64*a* to 64*d* extend downward from a top edge of the side wall 62*a*. Similarly, notches 64*a* to 64*d* are formed in a right side wall 62*b* of the drum unit main body 52. As shown in FIG. 2, when the developing units 70*a* to 70*d* are in an attached state in the drum unit main body 52, movement members 84 (described in detail below) of the developing units 70*a* to 70*d* are positioned within the notches 64*a* to 64*d*. In this state, the movement members 84 protrude to the exterior beyond the side walls 62*a* and 62*b*.

Next, the configuration of the developing unit 70*a* will be described. The remaining developing units 70*b* to 70*d* have a configuration the same as that of the developing unit 70*a*.

Figure 4:
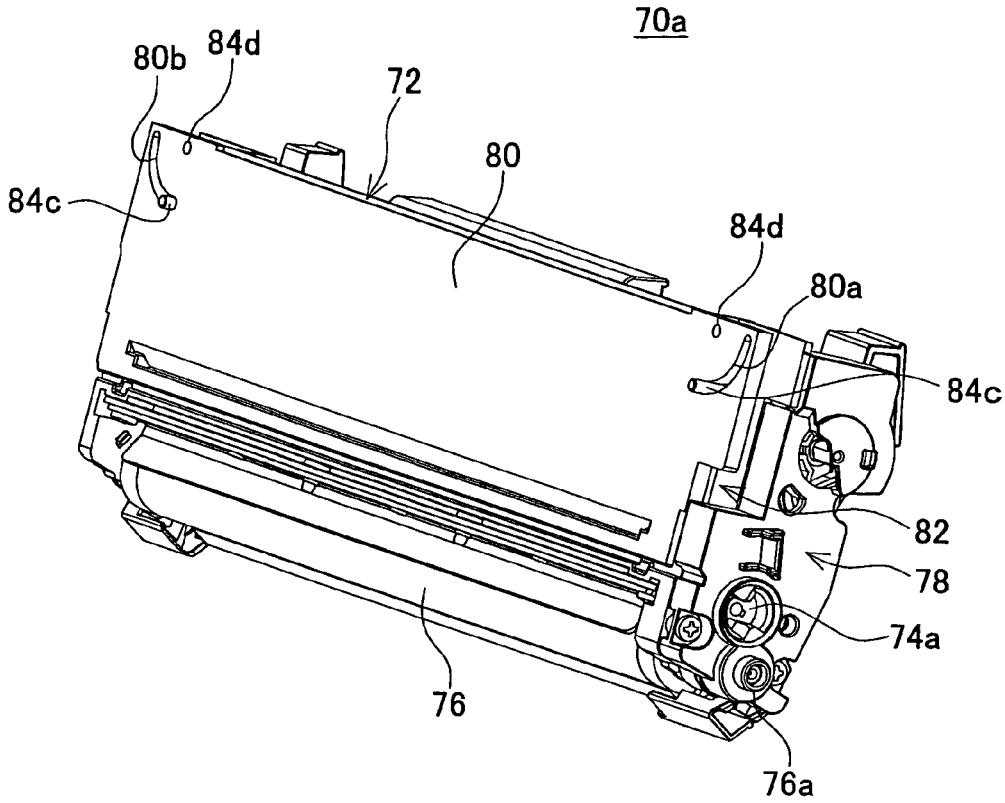
FIG. 4 shows a perspective view of a developing unit. A state is shown where each of movement members is in a housing position.

FIG. 4 shows a perspective view of the developing unit 70*a*. The toner case 72 of the developing unit 70*a* has a substantially rectangular parallelepiped shape. The toner case 72 has an opening (not shown) formed at a position facing the developing roller 76. The developing roller 76 is formed so as to cover the opening. The developing roller 76 includes a metal developing roller axis supported in a manner allowing its rotation by the toner case 72, and a conductive rubber roller that covers the periphery of the developing roller axis. One end and the other end of the developing roller axis are covered by a collar member 76*a*. The collar member 76*a* is exposed at a side surface 78 of the toner case 72. An input gear 74*a* is shown in FIG. 4. The input gear 74*a* is also exposed at the side surface 78 of the toner case 72. The input gear 74*a* is disposed between a driving gear (not shown) of the supply roller 74 and a driving gear of the developing roller 76, and meshes with these two gears. A rotational axis of the input gear 74*a*, a rotational axis of the developing roller 76, and a rotational axis of the supply roller 74 all extend in the same direction. A driving source (not shown) that rotates the input gear 74*a* is coupled with the developing unit 70*a*. When the input gear 74*a* is rotated, the supply roller 74 and the developing roller 76 rotate in synchrony in the opposite direction.

Long holes 80*a* and 80*b* are formed in a front surface 80 of the toner case 72. The long holes 80*a* and 80*b* pass through the front surface 80 of the toner case 72. Even though the long holes 80*a* and 80*b* pass through the toner case 72, the toner chamber 72*a* (see FIG. 1) is a closed space. That is, the toner chamber 72*a* does not communicate with the exterior via the long holes 80*a* and 80*b*. The long hole 80*a* is formed at a first corner of the two corners far from the developing roller 76. The long hole 80*a* is formed in an arc shape. The long hole 80*b* is formed at the other corner of the two corners far from the developing roller 76. The long hole 80*b* is a mirror image in the left-right direction of the long hole 80*a*.

Figure 5:
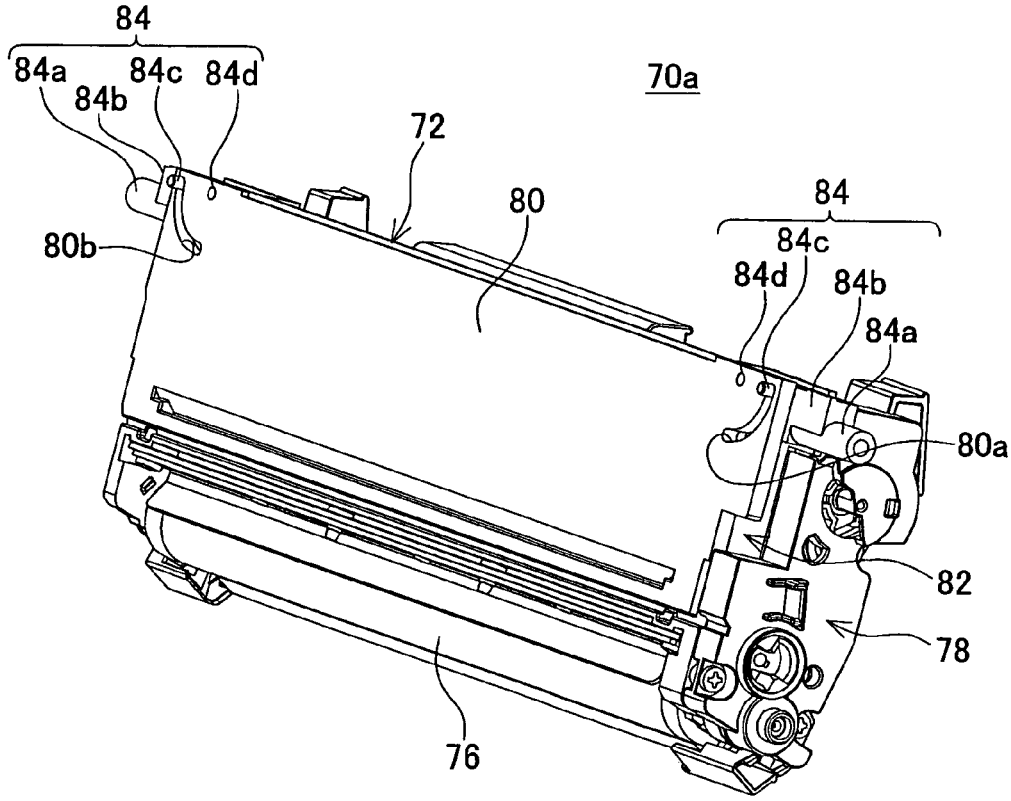
FIG. 5 shows a perspective view of the developing unit. A state is shown where each of the movement members is in a protruding position.

A concave portion 82 is formed between the side surface 78 and the front surface 80 of the toner case 72. Although this will be described in more detail below, two movement members 84 (see FIG. 5) are provided in the toner case 72. One of the movement members 84 is housed in the concave portion 82. A concave portion is also formed between a surface at the side opposite the side surface 78 and the front surface 80. The other of the movement members 84 is housed in this concave portion. In the state shown in FIG. 4, the pair of movement members 84 is housed in the toner case 72. In FIG. 5, the pair of movement members 84 is protruding from the toner case 72.

Figure 6:
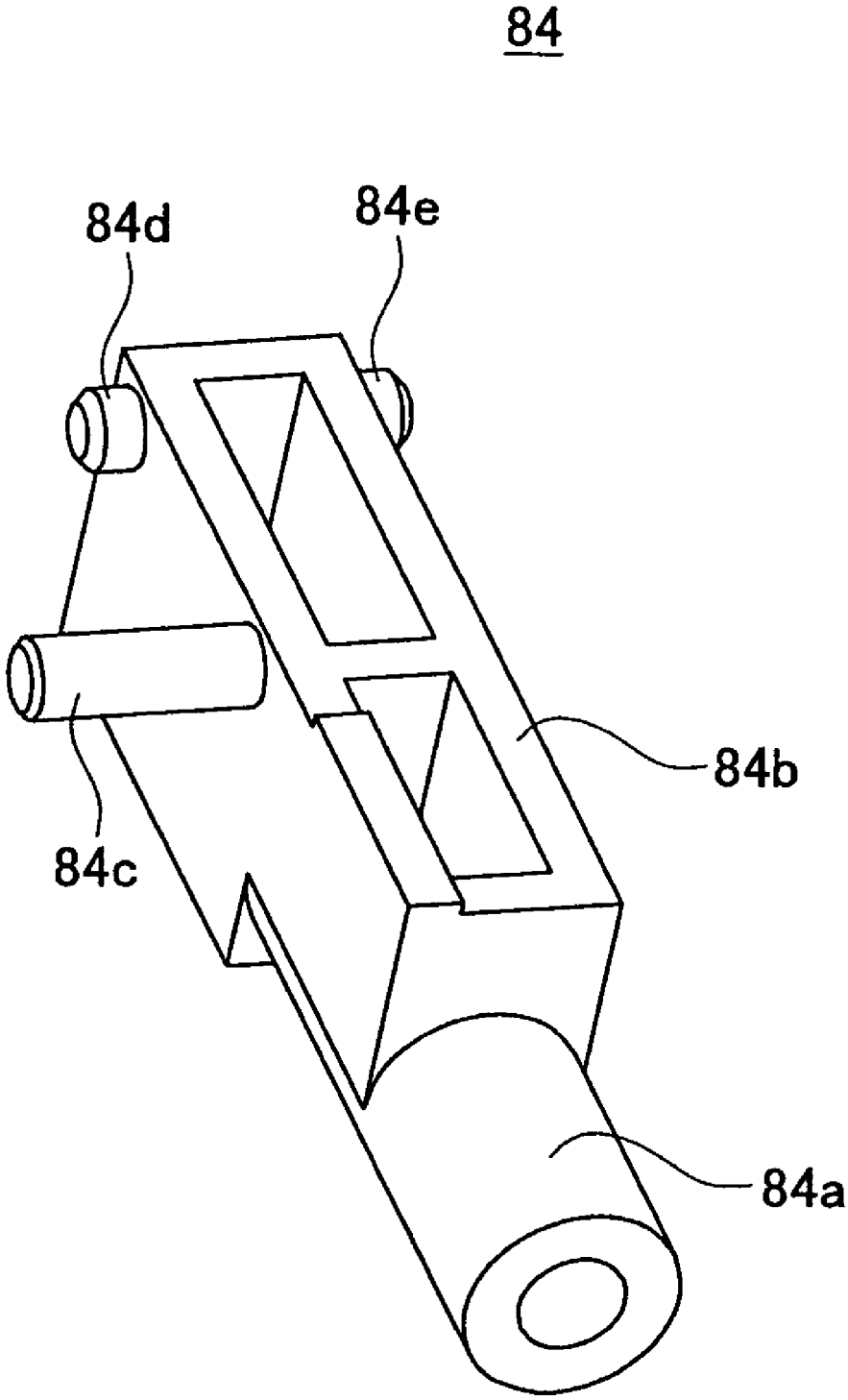
FIG. 6 shows a perspective view of the movement member.

FIG. 6 shows a perspective view of the movement member 84. The movement member 84 has a tubular portion 84*a*, a body 84*b*, a protruding portion 84*c*, and a pair of shafts 84*d* and 84*e*. The body 84*b* has a substantially rectangular parallelepiped shape. The tubular portion 84*a*, the protruding portion 84*c*, and the shafts 84*d* and 84*e* are fixed to the body 84*b*. The protruding portion 84*c* extends in a direction orthogonal to the direction in which the tubular portion 84*a* extends. The shaft 84*d* extends from the body 84*b* toward the left in FIG. 6. The other shaft 84*e* extends from the body 84*b* toward the right in FIG. 6.

As shown in FIG. 4, the protruding portion 84*c* of the first of the movement members 84 protrudes from the toner case 72 to the exterior via the long hole 80*a*. The protruding portion 84*c* of the other of the movement members 84 protrudes from the toner case 72 to the exterior via the long hole 80*b*. The protruding portions 84*c* can slide along the long holes 80*a* and 80*b*. The shafts 84*d* and 84*e* of the movement members 84 fit with the toner case 72 in a manner allowing its rotation. When the protruding portion 84*c* moves along the long hole 80*a* (or 80*b*), the movement member 84 rotates with the shafts 84*d* and 84*e* as its center.

As shown in FIG. 4, in the case where the protruding portion 84*c* is disposed at a lower end of the long hole 80*a* (80*b*), the movement member 84 is housed within the toner case 72. As shown in FIG. 5, in the case where the protruding portion 84*c* of the movement member 84 is disposed at an upper end of the long hole 80*a* (80*b*), the movement member 84 protrudes from the side surface 78 of the toner case 72. In the state shown in FIG. 5, the two movement members 84 are both protruding from the toner case 72. The first movement member 84 and the other movement member 84 are protruding in opposite directions.

In the present embodiment, the movement members 84 are disposed at positions away from the developing roller 76. The movement members 84 are disposed near an apex of the toner case 72.

Figure 7A:
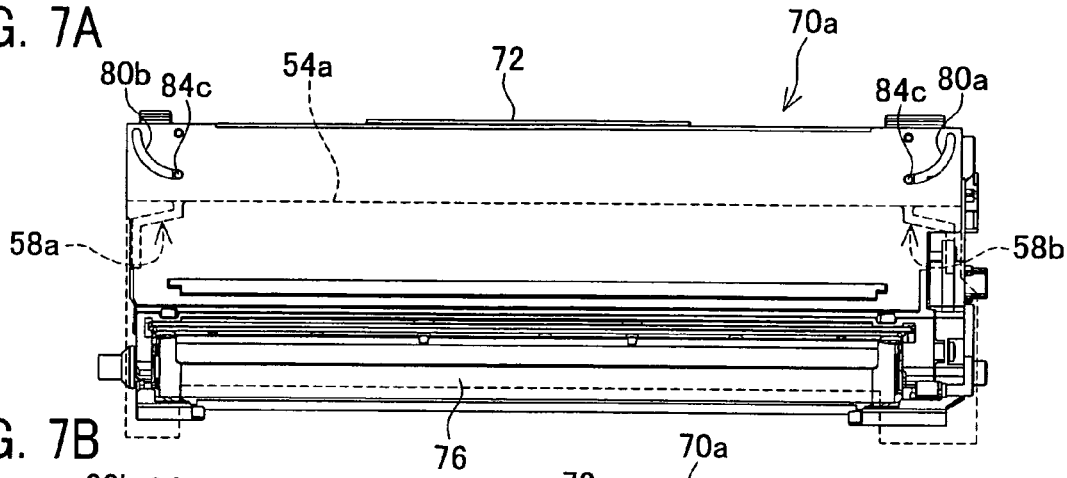
In FIG. 7A, the movement members are positioned at the housing position.
Figure 7B:
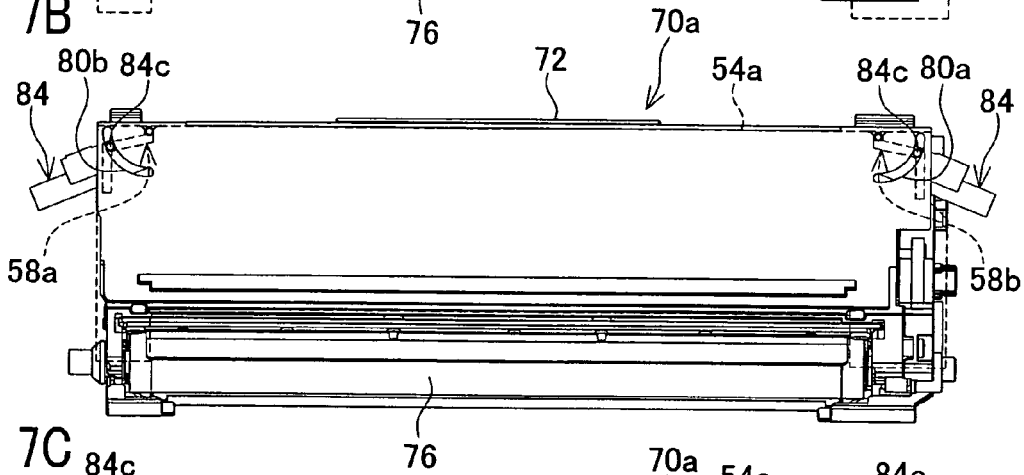
In FIG. 7B, the movement members are positioned between the housing position and the protruding position.
Figure 7C:
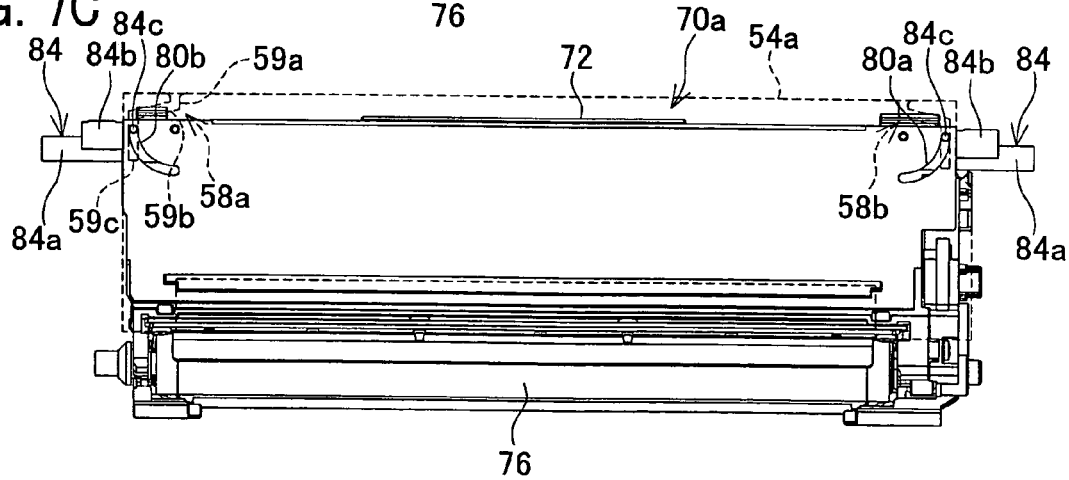
In FIG. 7C, the movement members are positioned at the protruding position.

FIG. 7A to 7C shows the rotation of the movement members 84 during the process, over time, of attaching the developing unit 70*a* to the drum unit main body 52 (see FIG. 2). In FIG. 7A to 7C, the separating plate 54*a* of the drum unit main body 52 is shown by a broken line.

The movement members 84 are housed within the toner case 72 when the developing unit 70*a* is not in an attached state in the drum unit main body 52 (see FIG. 7A). The developing unit 70*a* is slid in order to attach the developing unit 70*a* to the drum unit main body 52, whereupon the protruding portions 84*c* of the movement members 84 fit with the grooves 58*a* and 58*b* of the separating plate 54*a*. When the developing unit 70*a* is slid further, the protruding portions 84*c* are guided along the grooves 58*a* and 58*b* of the separating plate 54*a*. The protruding portions 84*c* thus move along the long holes 80*a* and 80*b*, and the movement members 84 rotate (see FIG. 7B). When the developing unit 70*a* is slid further from the state shown in FIG. 7B, the movement members 84 rotate further, and the state shown in FIG. 7C is reached. In the state shown in FIG. 7C, the two movement members 84 protrude from the toner case 72. In this state, the movement members 84 protrude in the axial direction of the developing roller 76 (in the left-right direction of FIG. 7C). With the movement members 84 that are in the state shown in FIG. 7C, the tubular portion 84*a* and a part of the body 84*b* are exposed at the exterior. In this state, the protruding portions 84*c* are located in the third parts 59*c* of the grooves 58*a* and 58*b*.

During the process of attaching the developing unit 70*a* to the drum unit main body 52, the developing unit 70*a* moves from a state where the movement members 84 are housed within the toner case 72 to a state where the movement members 84 protrude from the toner case 72. During the process of removing the developing unit 70*a* from the drum unit main body 52, the process goes from the state shown in FIG. 7C to the state shown in FIG. 7B and then to the state shown in FIG. 7A. That is, the process goes from the state where the movement members 84 protrude from the toner case 72 to the state where the movement members 84*c* are housed within the toner case 72.

In the state where the developing unit 70*a* is housed within the drum unit main body 52 (the state where the movement members 84 are protruding), two kinds of pushing forces operate on the movement members 84. Mechanisms for pushing the movement members 84 will be described next.

Figure 8:
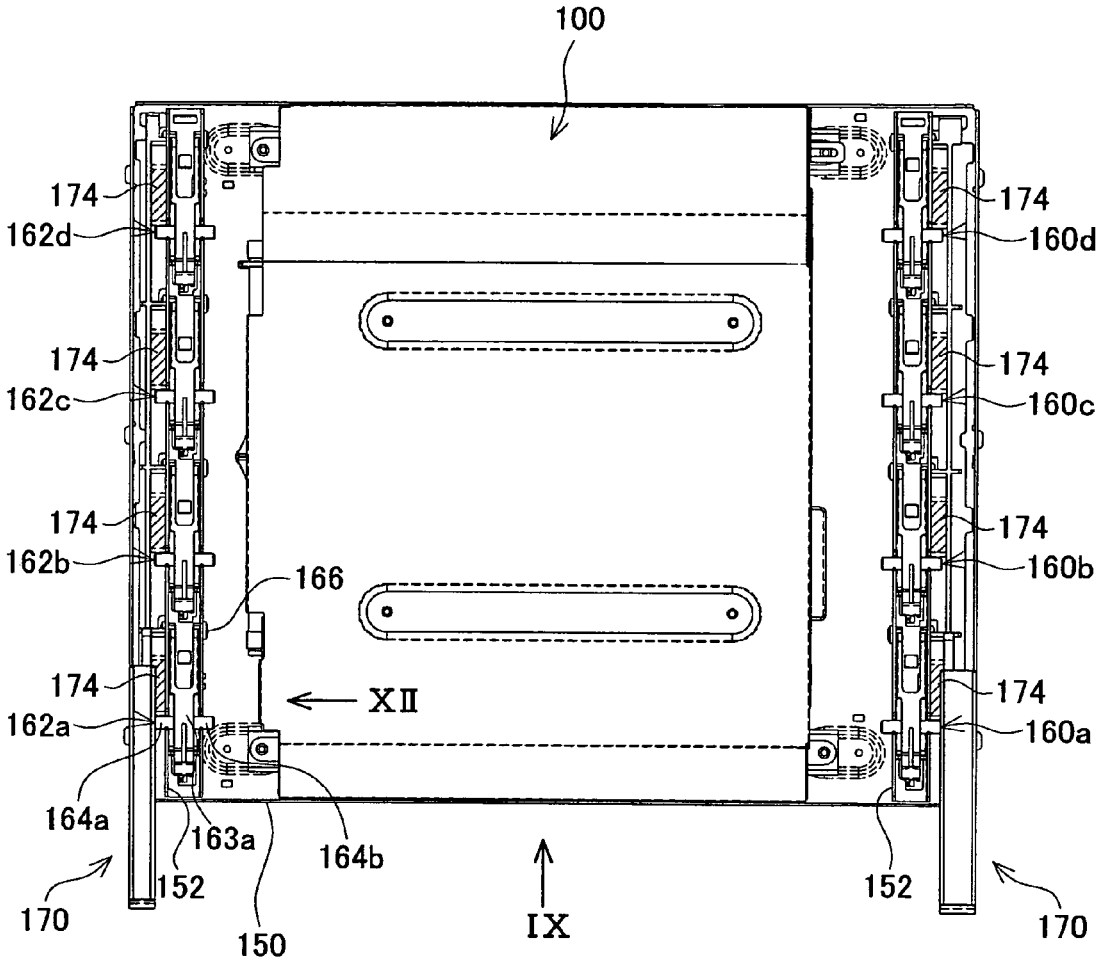
FIG. 8 shows a plan view of an exposure device and the surroundings thereof.
Figure 9:
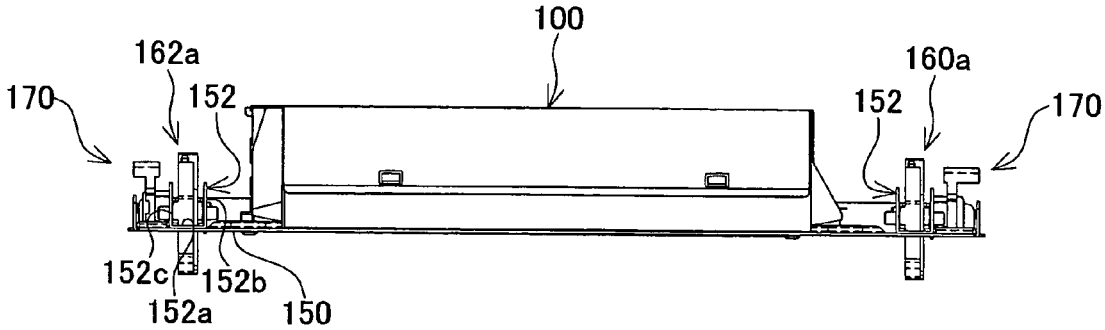
FIG. 9 shows a view from the direction of the arrow IX of FIG. 8.

FIG. 8 shows a plan view of the exposure device 100 and the surroundings thereof. FIG. 9 shows a view from the direction of the arrow IX of FIG. 8. The direction of the arrow IX is the same as the right direction in FIG. 1. The exposure device 100 is mounted on a top surface of a support plate 150 (see FIG. 9). A pair of guide members 152 and a pair of direct cam members 170 are disposed on the top surface of the support plate 150. The pair of guide members 152 is disposed so as to have the exposure device 100 located therebetween. The guide members 152 extend in the up-down direction of FIG. 8 (the left-right direction of FIG. 1). The length of the guide members 152 is approximately the same as the length of the exposure device 100 in the up-down direction of FIG. 8. The guide member 152 at the right side in FIGS. 8 and 9 supports four pushing members 160*a*, 160*b*, 160*c*, and 160*d*. The guide member 152 at the left side also supports four pushing members 162*a*, 162*b*, 162*c*, and 162*d*.

One of the direct cam members 170 is disposed at the right side of the exposure device 100 and one of the guide members 152. The other of the direct cam members 170 is disposed at the left side of the exposure device 100 and the other of the guide members 152. The direct cam members 170 extend in the up-down direction of FIG. 8 (the left-right direction of FIG. 1). Top ends, with respect to FIG. 8, of the direct cam members 170 are at approximately the same position as a top end of the exposure device 100. Bottom ends, with respect to FIG. 8, of the direct cam members 170 are lower than a bottom end of the exposure device 100.

Figure 10:
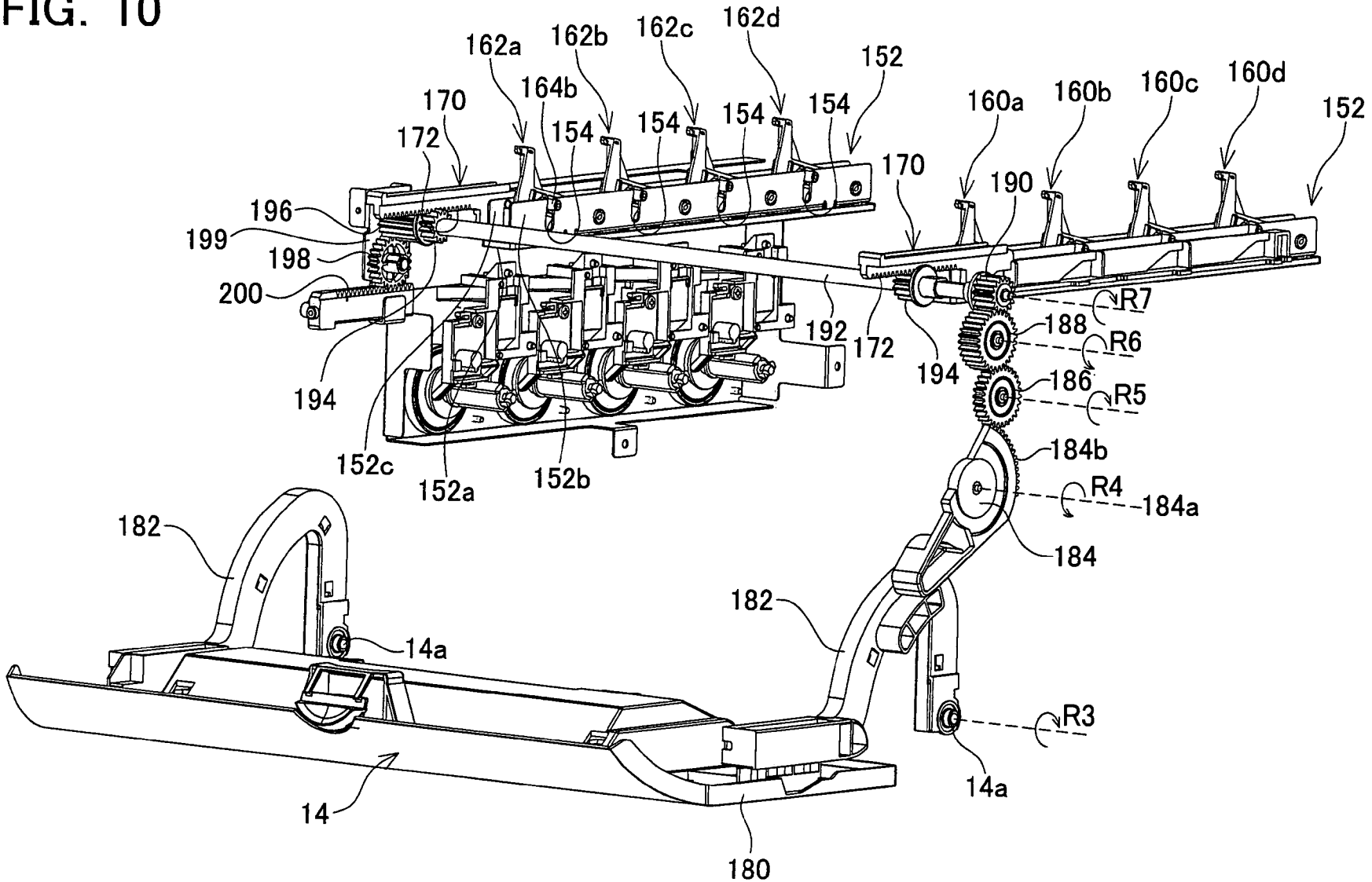
FIG. 10 shows a perspective view of guide members, direct cam members, and the surroundings thereof. A front side cover member is shown in an open state.
Figure 11:
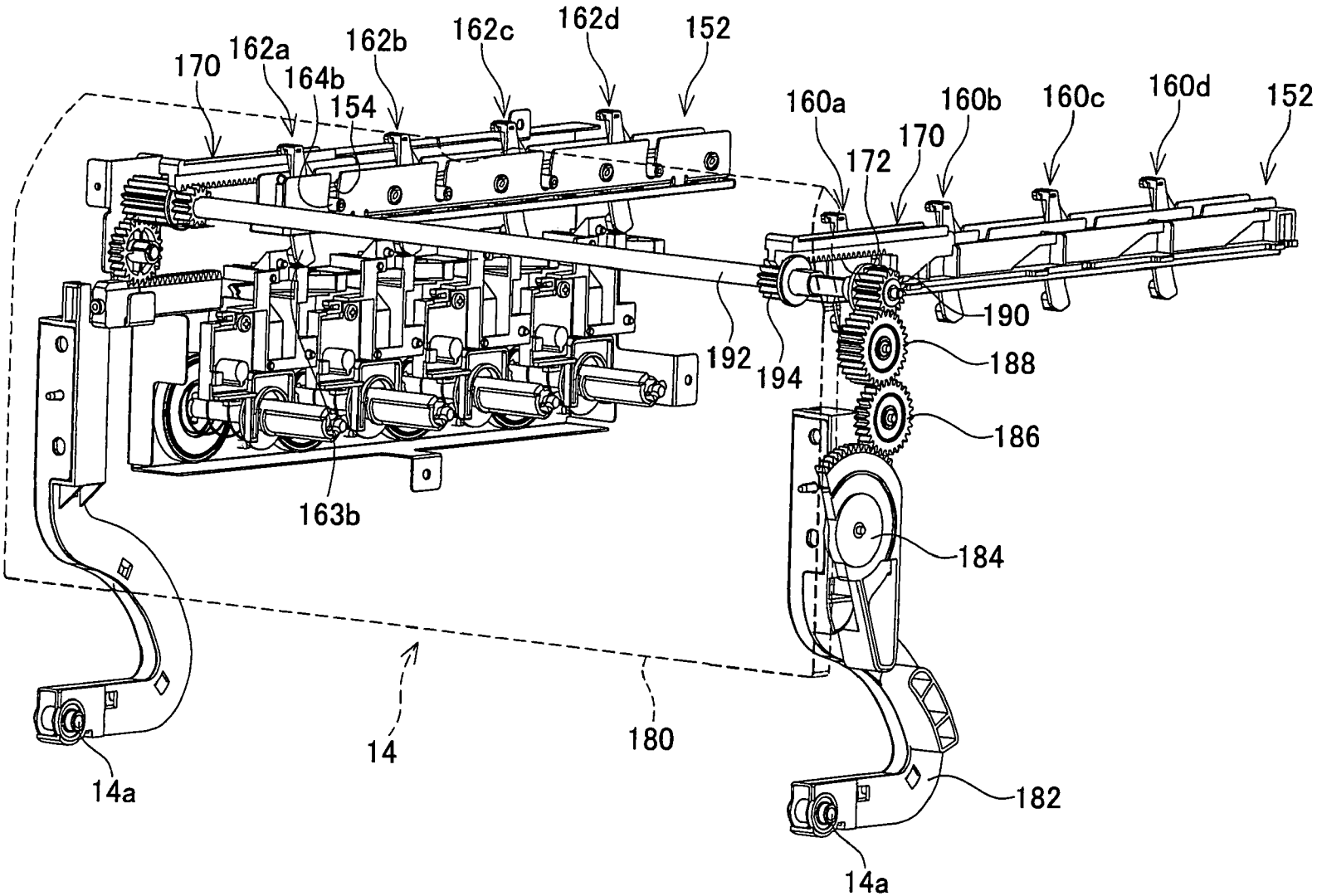
FIG. 11 shows a perspective view of the guide members, the direct cam members, and the surroundings thereof. The front side cover member is shown in a closed state.

FIG. 10 shows a perspective view of the pair of guide members 152, the pair of direct cam members 170, and the surroundings thereof. In FIG. 10, the front side cover member 14 (see FIG. 1) is shown in an open state. In FIG. 11, the front side cover member 14 (see FIG. 1) is shown in a state that has been closed from the state shown in FIG. 10.

The configuration of the guide members 152 will be described. Here, the configuration will be described of the guide member 152 at the left side in FIGS. 9 and 10. The right side guide member 152 has a configuration that is a mirror image in the left-right direction of the left side guide member 152. As shown in FIGS. 9 and 10, the guide member 152 has a bottom surface 152*a*, a right side surface 152*b* extending upward from a right edge (the right edge in FIG. 9) of the bottom surface 152*a*, and a left side surface 152*c* extending upward from a left edge (the left edge in FIG. 9) of the bottom surface 152*a*. A top surface of the guide member 152 forms an opening. The bottom surface 152*a* extends in the up-down direction of FIG. 8. Four holes (not shown) are formed in the bottom surface 152*a*. Holes (not shown) whose position corresponds to the holes of the bottom surface 152*a* are also formed in the support plate 150 (see FIG. 8). The pushing members 160*a* to 160*d* and 162*a* to 162*d* can protrude downward (downward in FIG. 9) via the holes of the bottom surface 152*a* and the support plate 150. This point will be described later in detail.

As shown in FIG. 10, four guide grooves 154 are formed in the right side surface 152*b* of the guide member 152. The guide grooves 154 extend downward from a top edge of the right side surface 152*b*. Although this cannot be seen in FIG. 10, four guide grooves are also formed in the left side surface 152*c*. The guide grooves of the left side surface 152*c* face the guide grooves of the right side surface 152*b*. That is, four pairs of grooves 154 are formed in one guide member 152.

Next, the configuration of the direct cam members 170 will be described. Below, the configuration will be described of the direct cam member 170 at the left side in FIGS. 9 and 10. The right side direct cam member 170 has a configuration that is a mirror image in the left-right direction of the left side direct cam member 170. The direct cam member 170 includes rack teeth 172. When a gear 194 that meshes with the rack teeth 172 rotates, the direct cam member 170 slides with respect to the guide member 152. The direct cam member 170 has four oblique plane members 174. In FIG. 8, the positions of the oblique plane members 174 have been hatched. In the FIG. 8, the bottom side of the oblique plane members 174 is low, and the top side of the oblique plane members 174 is high. That is, when one oblique plane member 174 is viewed from a side plane (viewed from the right-left direction of FIG. 8), the oblique plane member 174 has a substantially triangular shape.

Next, the configuration of a mechanism for sliding the direct cam members 170 will be described with reference to FIG. 10. The direct cam members 170 slide in conjunction with the opening and closing operations of the front side cover member 14.

The front side cover member 14 has a base part 180 and a pair of arm parts 182. The base part 180 is substantially plate shaped. One end of both the arm parts 182 is fixed to the base part 180. The other end of both the arm parts 182 is fixed to rotational shafts 14*a*. The rotational shafts 14*a* are connected to the main case 12 (see FIG. 1) in a manner allowing its rotation.

A first gear member 184 makes contact with the one of the arm parts 182. A rotational axis 184*a* of the first gear member 184 is coupled with a frame (not shown) in a manner allowing its rotation. The first gear member 184 has an arc shaped first gear 184*b*. A second gear 186 meshes with the first gear 184*b*. A third gear 188 meshes with the second gear 186. A fourth gear 190 meshes with the third gear 188. The second gear 186, the third gear 188, and the fourth gear 190 are each supported in a manner allowing its rotation by the frame (not shown). One end of a shaft 192 is coupled with the fourth gear 190. Two pinions 194 are fixed to the shaft 192. One of the pinions 194 meshes with the rack teeth 172 of the left side direct cam member 170. The other of the pinions 194 meshes with the rack teeth 172 of the right side direct cam member 170. The other end of the shaft 192 is coupled with a fifth gear 196. The fifth gear 196 meshes with a sixth gear 198. The fifth gear 196 and the sixth gear 198 are supported by a frame 199 in a manner allowing its rotation. The sixth gear 198 meshes with a rack member 200. The rack member 200 is supported by the frame 199 in a manner allowing its sliding.

When the front side cover member 14 is to be closed from an open state (see FIG. 10), the front side cover member 14 is swung in the direction of the arrow R3 using the rotational shafts 14*a* as the center. The arm part 182 presses the first gear member 184. The first gear member 184 thus rotates in the direction of the arrow R4. When the first gear member 184 rotates in the direction of the arrow R4, the second gear 186 rotates in the direction of the arrow R5. When the second gear 186 rotates in the direction of the arrow R5, the third gear 188 rotates in the direction of the arrow R6. When the third gear 188 rotates in the direction of the arrow R6, the fourth gear 190 rotates in the direction of the arrow R7. The shaft 192 thus rotates in the direction of the arrow R7. When the shaft 192 rotates in the direction of the arrow R7, the direct cam members 170 meshing with the pinions 194 slide in the upper right direction of FIG. 10 (the upward direction in FIG. 8). The state shown in FIG. 11 is thus reached.

When the front side cover member 14 is to be opened from the state shown in FIG. 11, the shaft 192 rotates in the opposite direction (the opposite direction from the arrow R7 in FIG. 10). In this case, the direct cam members 170 slide in the lower left direction of FIG. 11 (the downward direction in FIG. 8). The state shown in FIG. 10 is thus reached.

Next, the configuration of the pushing member 162*a* (see FIG. 8) will be described. The pushing members 162*b* to 162*d* are supported by the left side guide member 152 that is supporting the pushing member 162*a*, and have the same configuration as the pushing member 162*a*. Further, the pushing members 160*a* to 160*d*, which are coupled with the right side guide member 152, have a configuration that is a mirror image in the left-right direction of that of the pushing member 162*a*.

As shown in FIG. 8, the pushing member 162*a* has an arm part 163*a*, a pair of guide shafts 164*a* and 164*b*, etc. The arm part 163*a* extends in the up-down direction of FIG. 8. The first of the guide shafts 164*a* is coupled with a left side surface of the arm part 163*a*. The other of the guide shafts 164*b* is coupled with a right side surface of the arm part 163*a*. As shown in FIGS. 10 and 11, the other guide shaft 164*b* is disposed in the guide groove 154 of the guide member 152. Although this cannot be seen in FIGS. 10 and 11, the first guide shaft 164*a* is also disposed within the guide groove facing the guide groove 154. The pair of guide shafts 164*a* and 164*b* is guided along the pair of guide grooves 154.

Figure 12:
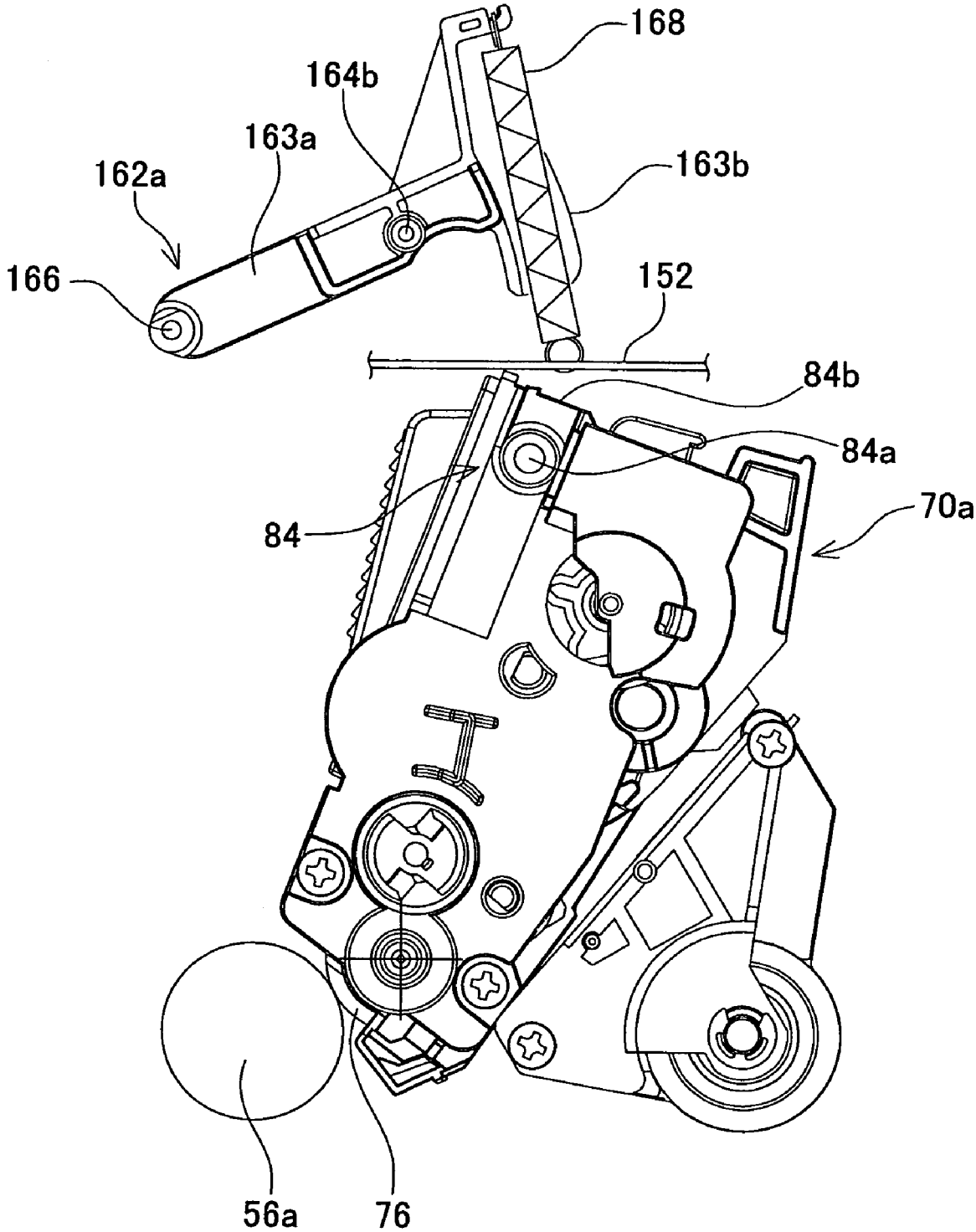
FIG. 12 shows a pushing member viewed from the XII direction of FIG. 8. The pushing member is shown in a state separated from the movement member.

FIG. 12 shows a front view of the pushing member 162*a* viewed from the XII direction of FIG. 8. In FIG. 12, the developing unit 70*a* is also shown. In addition to the arm part 163*a* and the pair of guide shafts 164*a* and 164*b*, the pushing member 162*a* has a contact part 163*b* and a coiled spring 168. The contact part 163*b* is coupled with one end of the arm part

163*a*. The contact part 163*b* extends in a direction perpendicular to the arm part 163*a*. As a result, when viewing FIG. 12, the pushing member 162*a* is substantially T shaped. A swing axis 166 is fixed to the other end of the arm part 163*a*. The swing axis 166 is supported by the guide member 152 (see FIG. 8) in a manner allowing its rotation. One end of the coiled spring 168 is coupled with a top end of the contact part 163*b*. The other end of the coiled spring 168 is coupled with the guide member 152.

FIG. 8 shows the front side cover member 14 in a closed state (the state of FIG. 1). When the front side cover member 14 is opened from this state, the direct cam members 170 slide downward with respect to FIG. 8. The oblique members 174 of the direct cam members 170 thus push the first of the guide shafts 164*a* of the pushing members 160*a*, etc. That is, the guide shafts 164*a* are pushed toward the closer side in a direction orthogonal to the plane of the page in FIG. 8 (pushed upward in FIG. 9). In this case, the pushing members 160*a*, etc. swing with the swing axis 166 as the center against the pushing force of the coiled spring 168.

Figure 13:
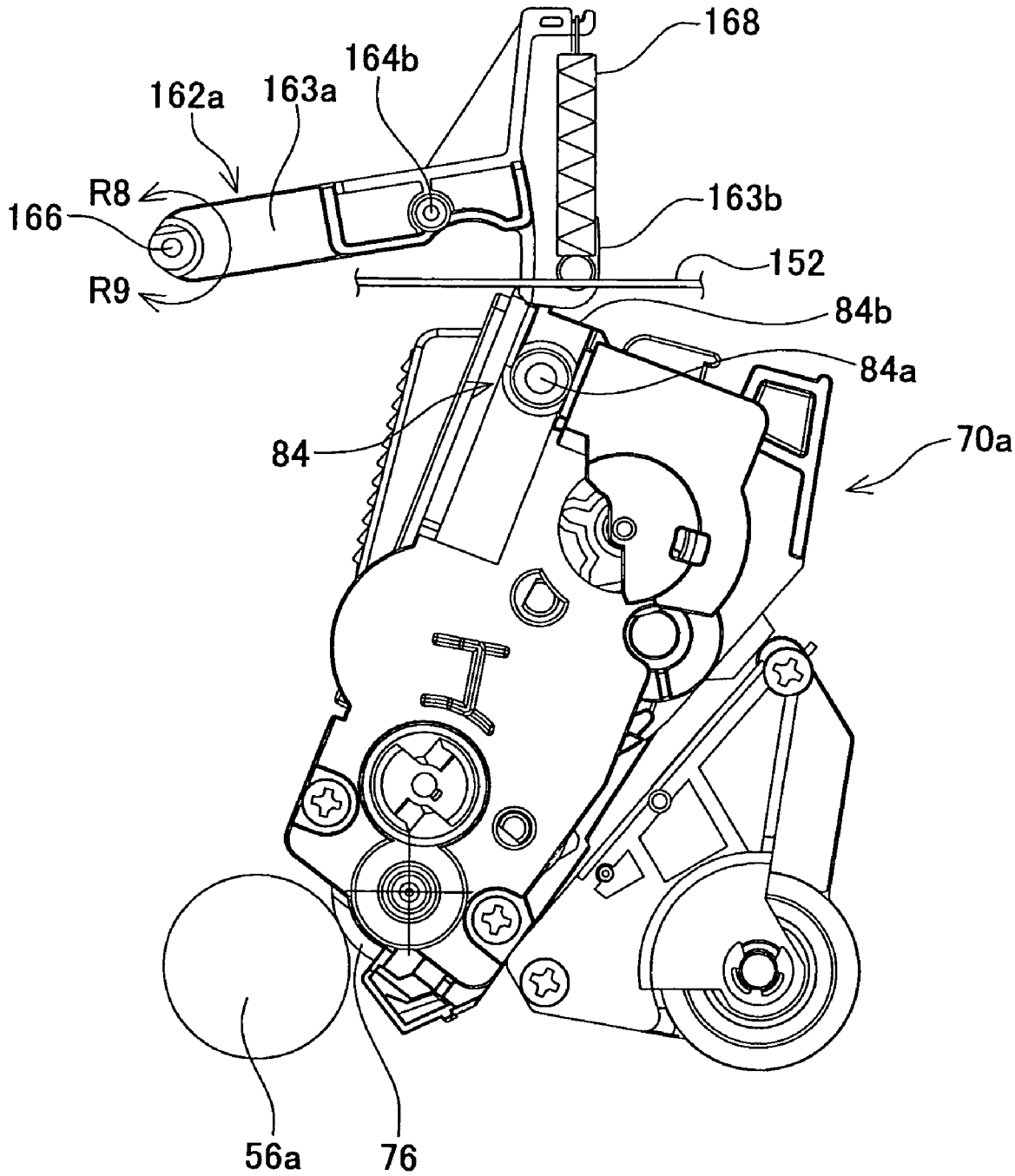
FIG. 13 shows the pushing member in a state making contact with the movement member.

FIG. 13 shows a front view of the pushing member 162*a* when the front side cover member 14 is in a closed state. When the front side cover member 14 is to be opened, the pushing member 162*a* swings in the direction of the arrow R8 with the swing axis 166 as the center. The state shown in FIG. 12 is thus reached. In the state shown in FIG. 12, the contact part 163*b* of the pushing member 162*a* is away from the developing unit 70*a*.

When the front side cover member 14 is to be closed from an open state, the direct cam members 170 slide upward in FIG. 8. In this case, the oblique members 174 of the direct cam members 170 are released from the state in which they push the pushing members 160*a*, etc. (the state shown in FIG. 8 is reached). In this case, the pushing force of the coiled spring 168 swings the pushing members 160*a*, etc. in the direction R9. The pushing members 160*a*, etc. thus protrude downward beyond the guide members 152 and the support plate 150 (see FIG. 8). That is, the state shown in FIG. 13 is reached. In this state, a bottom end of the contact part 163*b* of the pushing member 162*a* makes contact with the movement member 84 of the developing unit 70*a*. Specifically, the contact part 163*b* makes contact with the body 84*b* of the movement member 84. The pushing member 162*a* does not make contact with the tubular portion 84*a* of the movement member 84. In the state shown in FIG. 13, the coiled spring 168 is longer than its natural length. As a result, the pushing member 162*a* continues to push the movement member 84 downward.

When the movement member 84 is pushed downward, the entire developing unit 70 is pushed downward. The developing roller 76 thus presses the photoreceptor 56*a*. The developing roller 76 can press the photoreceptor 56*a* with a constant strength. In the present embodiment, the pushing members 160*a* to 160*d* and 162*a* to 162*d* push the developing units 70*a* to 70*d* downward. The developing rollers 76 of the developing units 70*a* to 70*d* can thus push the photoreceptors 56*a* to 56*d* with a constant strength.

Figure 14:
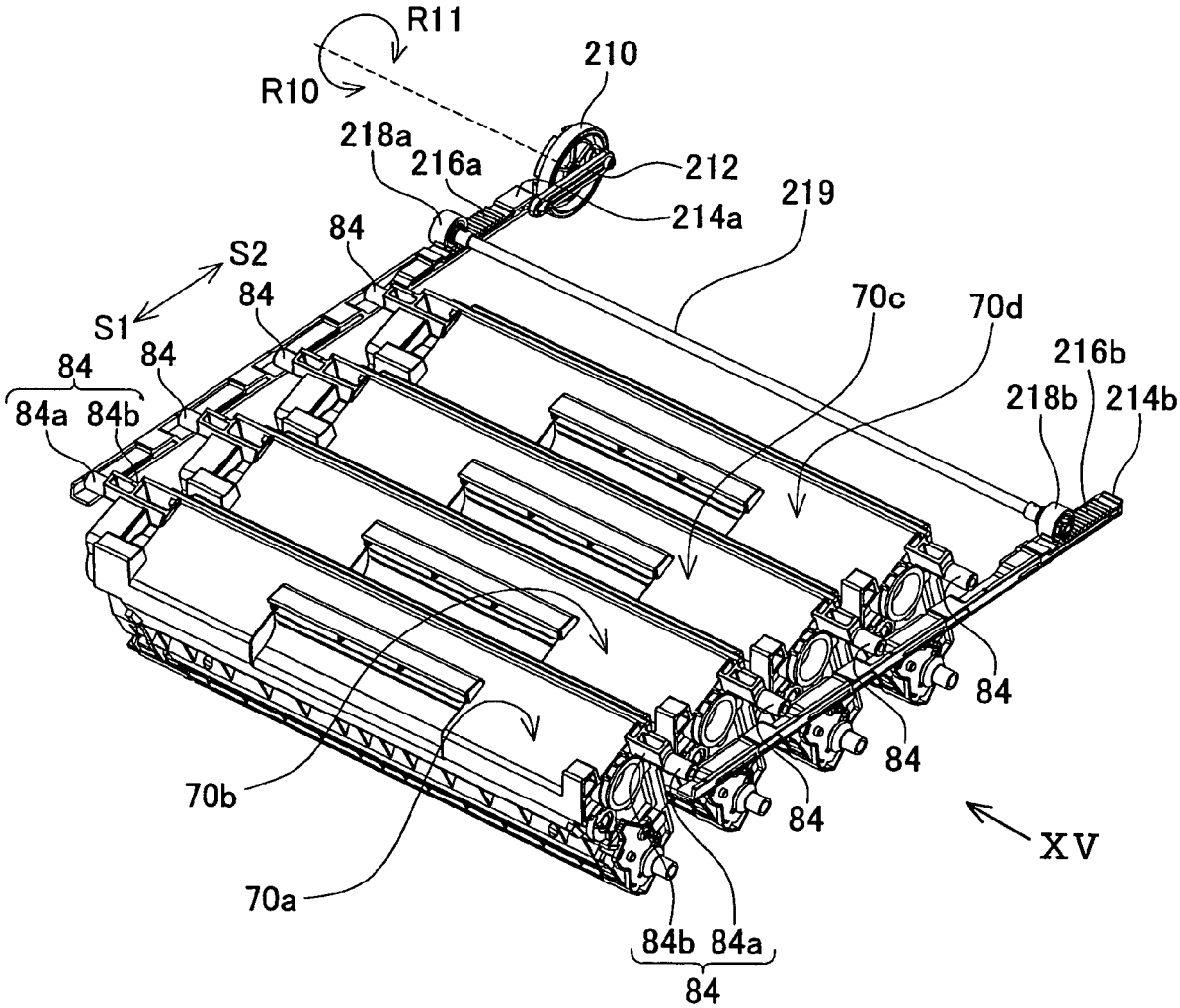
FIG. 14 shows a perspective view of a separating mechanism and the surroundings thereof.

Next, a mechanism (termed a separating mechanism) will be described that pushes the movement members 84 in a direction where the developing rollers 76 separate from the photoreceptor 56*a*, etc. FIG. 14 shows a perspective view of the separating mechanism. In FIG. 14, the four developing units 70*a* to 70*d* are shown. In FIG. 14, the drum unit main body 52 (see FIG. 2) is not shown.

The reference number 210 in FIG. 14 refers to a crank gear. The crank gear 210 is supported by the main case 12 in a manner allowing its rotation. A driving source (not shown) is coupled with the crank gear 210. When the driving source applies driving force to the crank gear 210, the crank gear 210 rotates in the direction of the arrow R10 or the arrow R11. One end of a transferring member 212 is coupled with the crank gear 210. The other end of the transferring member 212 is connected to one end of a cam plate 214*a*. The cam plate 214*a* extends in the direction of the arrow S1 (or S2) of FIG. 14. The cam plate 214*a* is supported by the main case 12 in a manner allowing sliding in the direction of the arrow S1 (or S2). Rack teeth 216*a* are formed at a top surface of the cam plate 214*a*. A pinion 218*a* meshes with the rack teeth 216*a*. One end of a shaft 219 is coupled with the pinion axis 218*a*. A pinion 218*b* is connected with the other end of the shaft 219. The pinion 218*a*, the shaft 219, and the pinion 218*b* are supported by the main case 12 in a manner allowing its rotation. Rack teeth 216*b* of a cam plate 214*b* mesh with the pinion 218*b*. The cam plate 214*b* extends in the direction of the arrow S1 (or S2) of FIG. 14. The cam plate 214*b* is supported by the main case 12 in a manner allowing sliding in the direction of the arrow S1 (or S2). The developing units 70*a* to 70*d* are disposed between the pair of cam plates 214*a* and 214*b*.

Figures 15A, 15B, 15C:
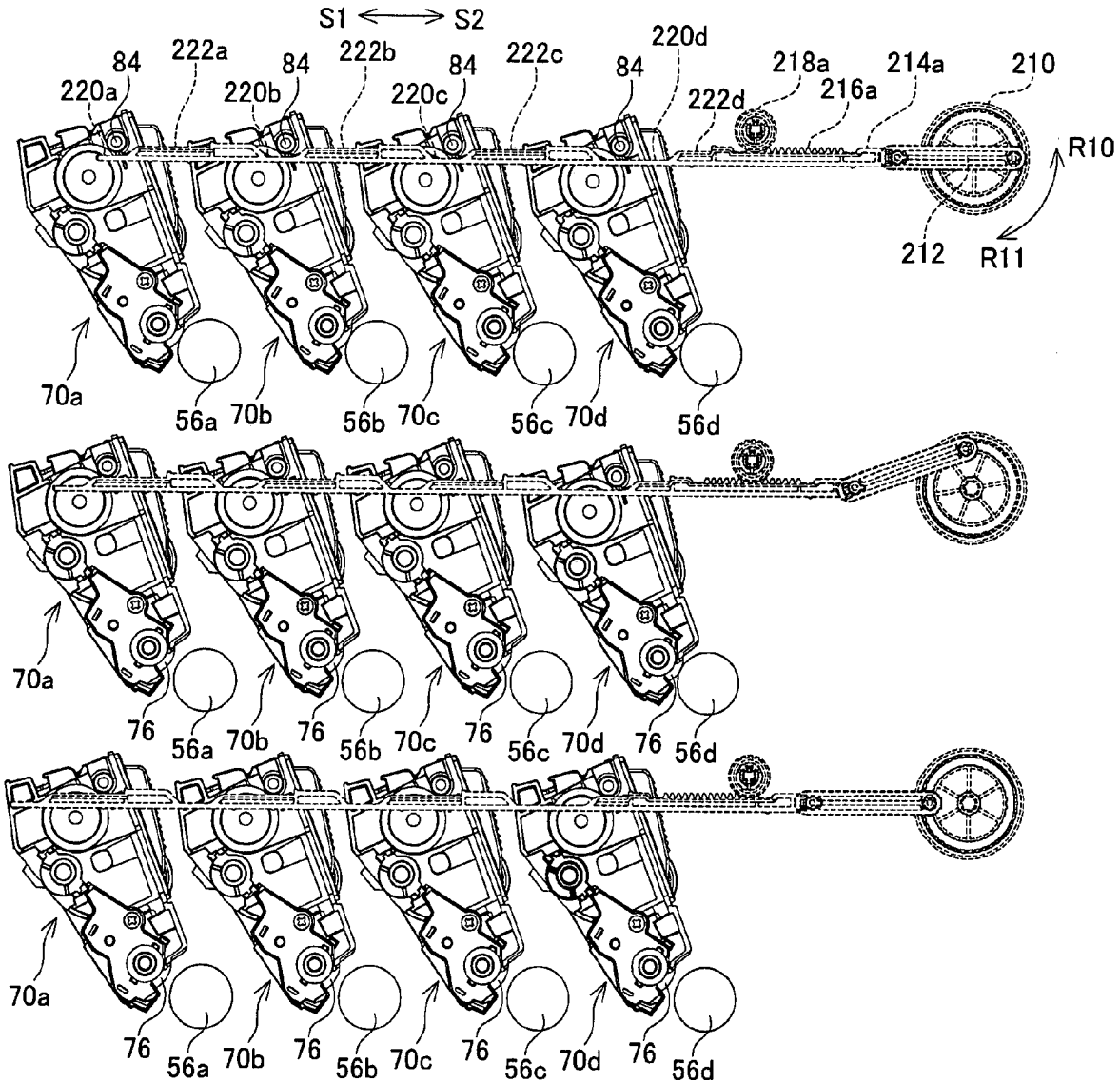
In FIG. 15A, all of photoreceptors are making contact with developing rollers.
In FIG. 15B, only one photoreceptor is making contact with the developing roller.
In FIG. 15C, none of the photoreceptors is making contact with the developing rollers.

The configuration of the cam plate 214*a* will now be described. The cam plate 214*b* has the same configuration as the cam plate 214*a*. FIG. 15A to 15C shows a view from the direction of the arrow XV of FIG. 14. In FIG. 15, the cam plate 214*b* has been omitted, and the cam plate 214*a* is shown by a broken line.

The cam plate 214*a* has four concave parts 220*a* to 220*d*, and four convex parts 222*a* to 222*d*. The concave parts 220*a* to 220*d* are formed lower than the convex parts 222*a* to 222*d*. The concave parts 220*a* to 220*d* are aligned in sequence from the left of the cam plate 214*a*. The three concave parts 220*a* to 220*c* have the same length in the left-right direction. The concave part 220*d* is longer in the left-right direction than the other three concave parts 220*a* to 220*c*. The convex part 222*a* is formed between the concave part 220*a* and the concave part 220*b*. The convex part 222*b* is formed between the concave part 220*b* and the concave part 220*c*. The convex part 222*c* is formed between the concave part 220*c* and the concave part 220*d*. The convex part 222*d* is formed between the concave part 220*d* and the rack teeth 216*a*.

In the state shown in FIG. 15A, the movement members 84 of the developing units 70*a* to 70*d* are in positions that correspond to the concave parts 220*a* to 220*d*. In this state, the movement members 84 do not make contact with the cam plate 214*a*. Similarly, the movement members 84 do not make contact with the cam plate 214*b*. The coiled spring 168 (see FIG. 13, etc.) presses the developing units 70*a* to 70*d* against the photoreceptors 56*a* to 56*d*. In this state, color printing can be executed utilizing the four colors (CMYK) of toner.

When the crank gear 210 is rotated in the direction of the arrow R10 from the state shown in FIG. 15A, the cam plate 214*a* is pushed toward the left via the transferring member 212. The cam plate 214*a* thus slides in the direction of the arrow S1. The pinion 218*a* that meshes with the rack teeth 216*a* of the cam plate 214*a* rotates. The shaft 219 and the pinion 218*b* consequently rotate, and the other cam plate 214*b* also slides in the direction of the arrow S1. The pair of cam plates 214*a* and 214*b* slide in synchrony. When the crank gear 210 has been rotated 90 degrees in the direction of the arrow R10 from the state shown in FIG. 15A, the state shown in FIG. 15B is reached. In this state, the movement member 84 of the developing unit 70*a* rides over the convex part 222*a* of the cam plate 214*a* (214*b*). The movement member 84 of the developing unit 70*a* is thus pushed upward. Since the entire developing unit 70*a* is being lifted, the developing roller 76 separates from the photoreceptor 56*a*. As is clear from FIG. 14, the cam plate 214*a* (214*b*) pushes the tubular portion 84*a* of the movement member 84. The body 84*b* of the movement member 84 does not make contact with the cam plate 214*a* (214*b*).

As with the case of the developing unit 70*a*, the movement member 84 of the developing unit 70*b* rides over the convex part 222*b* of the cam plate 214*a* (214*b*) in the state shown in FIG. 15B. Further, the movement member 84 of the developing unit 70*c* rides over the convex part 222*c* of the cam plate 214*a* (214*b*). The developing units 70*b* and 70*c* are lifted, and the developing rollers 76 separate from the photoreceptors 56*b* and 56*c*.

The length of the concave part 220*d* in the left-right direction is greater than the length of the remaining concave parts 220*a* to 220*c*. As a result, the movement member 84 of the developing unit 70*d* remains in a position corresponding to the concave part 220*d* in the state shown in FIG. 15B. The movement member 84 of the developing unit 70*d* does not ride over the convex part 222*d*. Only the developing unit 70*d* is pressed against the photoreceptor 56*d*. In this state, monochrome printing utilizing only black toner can be executed.

When the crank gear 210 is rotated a further 90 degrees in the direction of the arrow R10 from the state shown in FIG. 15B, the state shown in FIG. 15C is reached. In this state, the movement member 84 of the developing unit 70*d* also rides over the convex part 222*d* of the cam plate 214*a* (214*b*). The movement member 84 of the developing unit 70*d* is thus pushed upward. The developing roller 76 separates from the photoreceptor 56*d*. In this state, the developing rollers of all the developing units 70*a* to 70*d* are separated from the photoreceptors 56*a* to 56*d*. The state shown in FIG. 15C is maintained while the printer 2 is not being used.

The configuration of the printer 2 of the present embodiment has been described in detail. As described above, in the printer 2 of the present embodiment, the movement members 84 of the developing units 70*a* to 70*d* can move between a position in which they are housed in the toner case 72 (the state shown in FIG. 4) and a position in which they protrude from the toner case 72 (the state shown in FIG. 5). The movement members 84 are in the protruding position when the drum unit main body 52 is in a housed state. The movement members 84 that are in the protruding position are pushed by the pushing members 160*a*, etc. The developing rollers 76 of the developing units 70*a*, etc. are thus pressed toward the photoreceptors 56*a*, etc. Since the developing rollers 76 make contact with the photoreceptors 56*a*, etc. at a constant strength, it is possible to supply the toner at a constant amount from the developing rollers 76 to the photoreceptors 56*a*, etc. The thickness is thus stabilized of the visible image supported on the photoreceptors 56*a*, etc.

In the state where the developing units 70*a*, etc. are not attached to the drum unit main body 52, the movement members 84 can be maintained in the housing position. It is therefore possible to prevent the phenomenon from occurring wherein force is applied unexpectedly to the movement members 84. Damage to the movement members 84 can consequently be prevented.

Further, in the present embodiment the following states can be realized: a state where the developing rollers 76 of all the developing units 70*a*, etc. are making contact with the photoreceptors 56*a*, etc. (FIG. 15A), a state where the developing roller 76 of only the developing unit 70*d* makes contact with the photoreceptor 56*d* (FIG. 15B), and a state where the developing rollers 76 of all the developing units 70*a*, etc. are not making contact with the photoreceptors 56*a*, etc. (FIG. 15C). In order to realize these states, the movement members 84 that are in the protruding position are pushed in a direction to separate the developing rollers 76 from the photoreceptors 56*a*, etc. This separating force is applied to the tubular portions 84*a* of the movement members 84. By contrast, the pushing members 160*a*, etc. push the bodies 84*b* of the movement members 84 (this is termed pushing force). The parts to which separating force is applied and the parts to which pushing force is applied are different, and consequently the load on the movement members 84 is dispersed.

Further, in the present embodiment, the movement members 84 of the developing units 70*a*, etc. move from the housing position to the protruding position during the process of attaching the developing units 70*a*, etc. to the drum unit main body 52. Furthermore, the movement members 84 of the developing units 70*a*, etc. move from the protruding position to the housing position during the process of detaching the developing units 70*a*, etc. from the drum unit main body 52. A user does not need to move the movement members 84 manually. Extremely convenient developing units 70*a*, etc. can therefore be realized.

Second Embodiment

Figure 16:
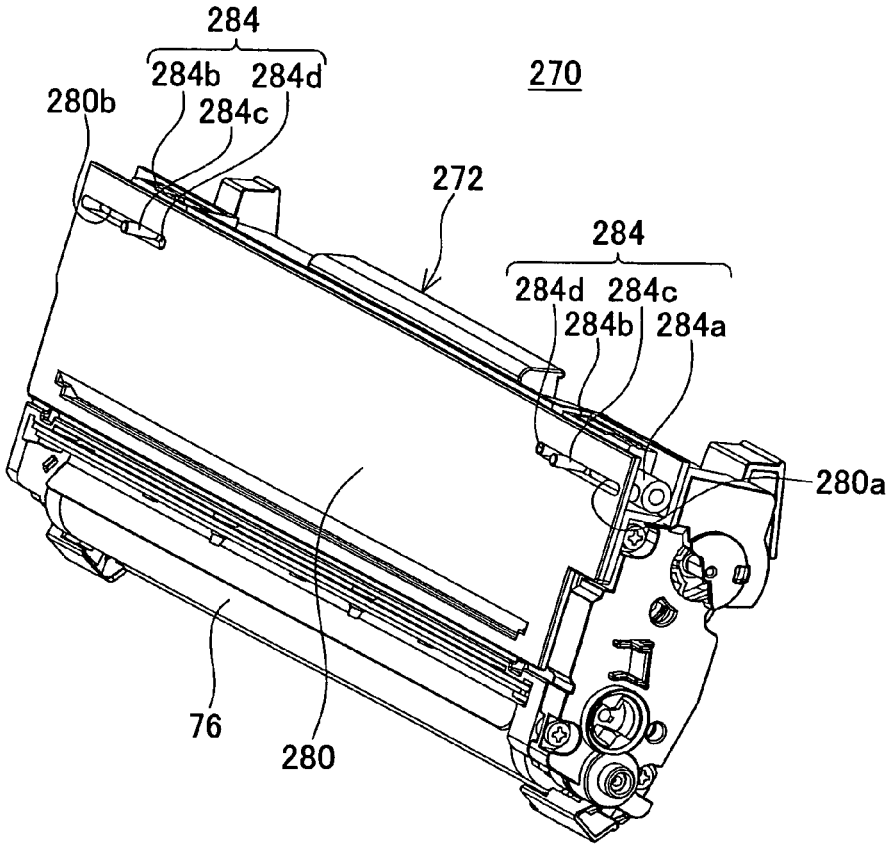
FIG. 16 shows a perspective view of a developing unit of the second embodiment. A state is shown where the movement member is in the housing position.

Only parts differing from the first embodiment will be described. In the present embodiment, the configuration of the developing units differs from that of the first embodiment. FIG. 16 is a perspective view of a developing unit 270 of the present embodiment.

Figure 17:
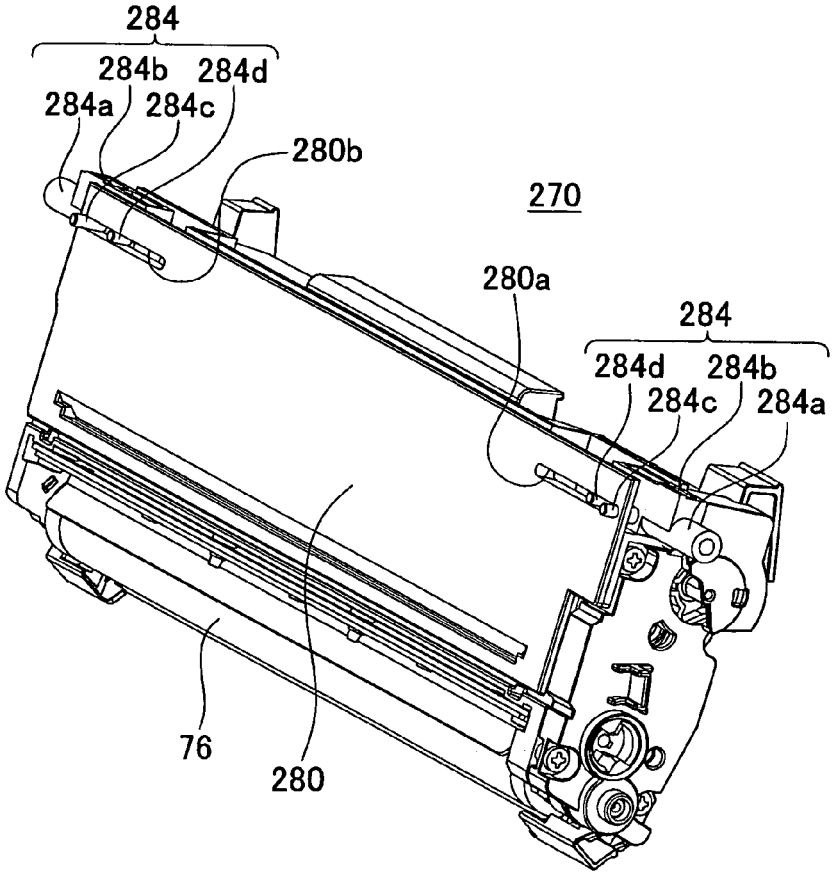
FIG. 17 shows a perspective view of the developing unit of the second embodiment. A state is shown where the movement members are in the protruding position.

A pair of long holes 280*a* and 280*b* is formed in a front surface 280 of a toner case 272. The long holes 280*a* and 280*b* extend in a rotation axis direction of the developing roller 76. In the state shown in FIG. 16, a pair of movement members 284 is housed within a toner case 272. FIG. 17 shows the developing unit 270 in a state where the movement members 284 are protruding.

As shown in FIG. 17, the pair of movement members 284 each has a tubular portion 284*a*, a body 284*b*, a protruding part 284*c*, and a regulating part 284*d*. The tubular portion 284*a* is fixed to the body 284*b*. The protruding part 284*c* extends from the body 284*b*. The protruding part 284*c* of the right side movement member 284 protrudes to the exterior from the toner case 272 via the long hole 280*a*. The protruding part 284*c* of the left side movement member 284 protrudes to the exterior from the toner case 272 via the long hole 280*b*. The regulating part 284*d* extends from the body 284*b*. The regulating part 284*d* extends in the same direction as the protruding part 284*c*. The regulating part 284*d* is shorter than the protruding part 284*c*. In the state shown in FIG. 16, the regulating parts 284*d* are positioned at inner ends of the long holes 280*a* and 280*b*. The regulating parts 284*d* regulate the movement inwards of the movement members 284 from the state shown in FIG. 16.

Figure 18A:
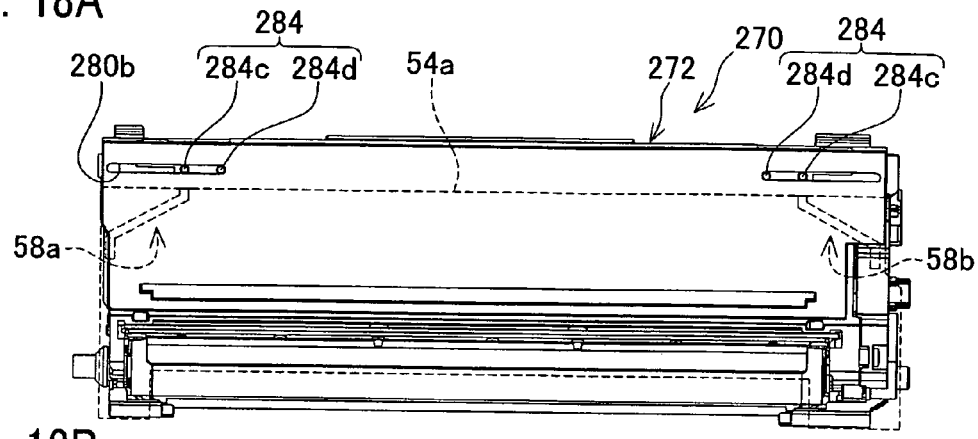
In FIG. 18A, the movement members are positioned at the housing position.
Figure 18B:
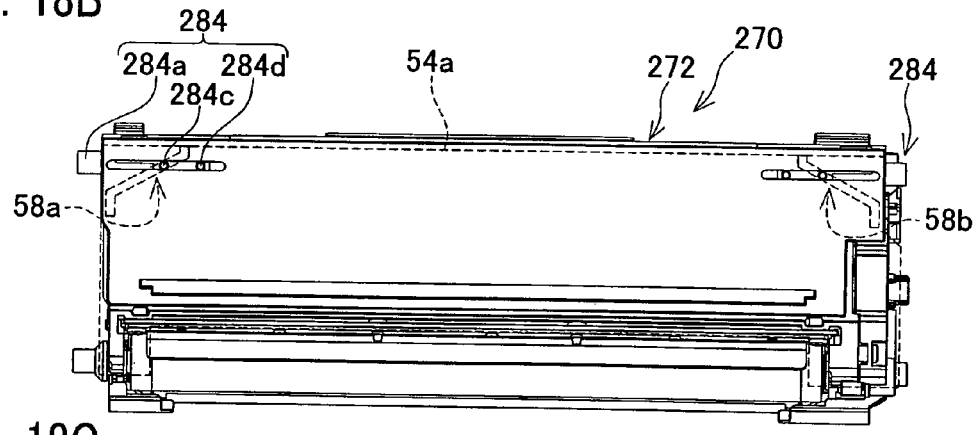
FIG. 18 shows a process, over time, of attaching the developing unit of the second embodiment to the drum unit main body.
Figure 18C:
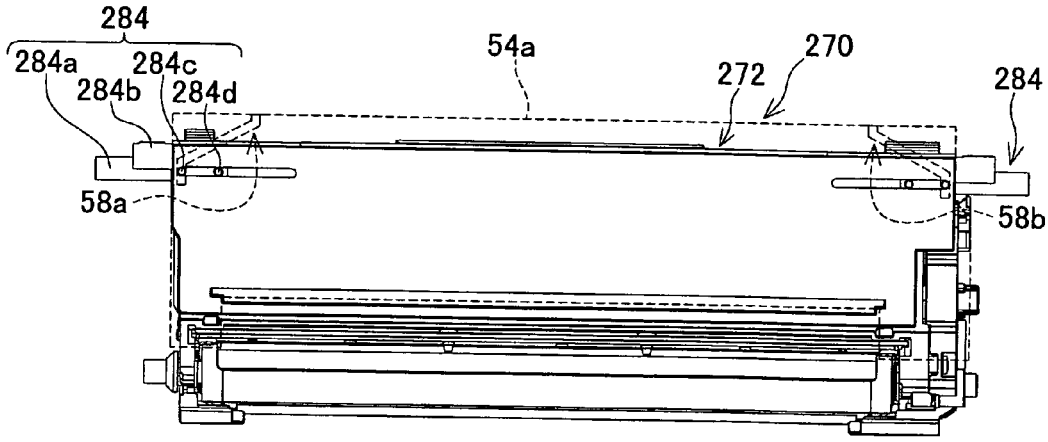

FIG. 18 shows how, over time, the developing unit 270 is attached to the drum unit main body 52 (see FIG. 2). In FIG. 18A to 18C, the separating plate 54*a* of the drum unit main body 52 is shown by a broken line.

In the state where the developing unit 270 is not attached to the drum unit main body 52, the movement members 284 are housed within the toner case 272 (FIG. 18A). When the developing unit 270 is slid so as to attach the developing unit 270 to the drum unit main body 52, the protruding parts 284*c* of the movement members 284 fit with the grooves 58*a* and 58*b* of the separating plate 54*a*. When the developing unit 270 is slid further, the protruding parts 284*c* are guided along the grooves 58*a* and 58*b* of the separating plate 54*a*. The protruding parts 284*c* thus move along the long holes 280*a* and 280*b*. The right side movement member 284 slides toward the right, and the left side movement member 284 slides toward the left (FIG. 18B). When the developing unit 270 is slid further from the state shown in FIG. 18B, the movement members 284 slide further, and the state shown in FIG. 18C is reached. In the state shown in FIG. 18C, the movement members 284 protrude from the toner case 272. The movement members 284 that are in the protruding position protrude in the axial direction (the left-right direction) of the developing roller 76.

With the developing unit 270 of the present embodiment, the movement members 284 move from a state of being housed in the toner case 272 to a state of protruding from the toner case 272 during the process of attaching the developing unit 270 to the drum unit main body 52. Furthermore, the movement members 284 move from the state of protruding from the toner case 272 to the state of being housed in the toner case 272 during the process of detaching the developing unit 270 from the drum unit main body 52.

A developing unit 270 having movement members 284 that can move between the housing position and the protruding position can thus also be realized utilizing the configuration of the present embodiment.

Specific examples of embodiments of the present invention are presented above, but these merely illustrate some possibilities of the invention and do not restrict the scope of the invention. The technique set forth in this specification encompasses various transformations and modifications to the embodiments described above.

(1) As described above, it is preferred that the movement members 84 protrude from the side surface 78 of the toner case 72 (see FIG. 4). However, the movement members may protrude from, for example, the front surface 80 of the toner case 72 (see FIG. 4).

(2) The grooves 58*a* and 58*b* of the drum unit main body 52 may be grooves without a base.

(3) The technique of the present embodiments can be applied to a laser printer that performs printing using more than four colors. Further, it can be applied to a laser printer that performs only monochromatic printing. A laser printer for monochromatic printing utilizes one photoreceptor and one developing unit. In this case, a mechanism for separating the developing roller from the photoreceptor need not be provided.

(4) The drum unit 50 need not be removable from the main case 12. In this case, a configuration is adopted wherein the developing units 70*a* to 70*d* are attached directly to the main case 12.

Furthermore, the technical elements disclosed in the present specification or figures have technical utility separately or in each of combinations of these, and are not limited to the combinations set forth in the claims at the time of this application. Furthermore, the art disclosed in the present specification or figures may be utilized to simultaneously realize a plurality of aims or to realize one of these aims.

What is claimed is:

1. A developing unit attachable to and detachable from an image forming device main body, comprising:

a developer case that accommodates developer;

a developing roller coupled with the developer case, the developing roller being configured to supply the developer accommodated in the developer case to a photoreceptor; and a movement member coupled with the developer case, the movement member being configured to move between a housing position where the movement member is substantially housed inside the developer case and a protruding position where the movement member protrudes beyond the developer case, wherein the movement member is positioned at the protruding position and pushed by the image forming device main body in a predetermined direction while the developing unit is being attached to the image forming device main body, and the movement member moves between the housing position and the protruding position by moving linearly with respect to the developer case.

2. The developing unit as in claim 1, wherein the movement member is pushed by the image forming device main, body in a first direction, and the first direction is a direction where the developing roller presses the photoreceptor.

3. The developing unit as in claim 1, wherein the movement member is pushed by the image forming device main body in a second direction, and the second direction is a direction where the developing roller separates from the photoreceptor.

4. The developing unit as in claim 1, wherein the movement member is pushed by the image forming device main body in a first direction and a second direction, the first direction is a direction where the developing roller presses the photoreceptor, and the second direction is a direction where the developing roller separates from the photoreceptor.

5. The developing unit as in claim 1, wherein the movement member positioned at the protruding position protrudes beyond the developer case in a rotational axis direction of the developing roller.

6. The developing unit as in claim 1, wherein the developer case has a substantially rectangular parallelepiped shape, the developing roller is disposed on a predetermined surface of the developer case, and the movement member is adjacent to an apex of an opposite surface of the predetermined surface.

7. A developing unit attachable to and detachable from an image forming device main body, comprising:

a developer case that accommodates developer;

a developing roller coupled with the developer case, the developing roller being configured to supply the developer accommodated in the developer case to a photoreceptor; and a movement member coupled with the developer case, the movement member being configured to move between a housing position where the movement member is substantially housed inside the developer case and a protruding position where the movement member protrudes beyond the developer case, wherein the movement member is positioned at the protruding position and pushed by the image forming device main body in a predetermined direction while the developing unit is being attached to the image forming device main body, the developer case comprises a long hole, the movement member comprises a protruding portion that protrudes beyond the developer case via the long hole, the movement member is positioned at the housing position when the protruding portion is positioned at a first position with respect to the long hole, the movement member is positioned at the protruding position when the protruding portion is positioned at a second position with respect to the long hole, in a process where the developing unit is attached to the image forming device main body, the image forming device main body makes contact with the protruding portion, and the protruding portion is guided from the first position to the second position, and in a process where the developing unit is detached from the image forming device main body, the image forming device main body makes contact with the protruding portion, and the protruding portion is guided from the second position to the first position.

8. An image forming device main body to which the developing unit as in claim 7 is attached, the image forming device main body comprising:

a casing comprising a space for housing the developing unit;

the photoreceptor disposed at a position facing the space;

a pushing member that pushes the movement member in the predetermined direction while the developing unit is being attached to the image forming device main body, and a plate comprising a groove that guides the protruding portion of the movement member of the developing unit in the process where the developing unit is attached to the image forming device main body and in the process where the developing unit is detached from the image forming device main body.

9. An image forming device, comprising:

an image forming device main body; and a developing unit detachably attached to the image forming device main body, wherein the image forming device main body comprises:

a casing comprising a space for housing the developing unit;

a photoreceptor disposed at a position facing the space; and a pushing member, wherein the developing unit comprises:

a developer case that accommodates a developer;

a developing roller coupled with the developer case, the developing roller being configured to supply the developer accommodated in the developer case to the photoreceptor; and a movement member coupled with the developer case, the movement member being configured to move between a housing position where the movement member is substantially housed inside the developer case and a protruding position where the movement member protrudes beyond the developer case, wherein, in a process where the developing unit is attached to the image forming device main body, the movement member moves from the housing position to the protruding position, in a process where the developing unit is detached from the image forming device main body, the movement member moves from the protruding position to the housing position, the pushing member pushes the movement member in a predetermined direction while the developing unit is being housed in the casing, and the movement member moves between the housing position and the protruding position by moving linearly with respect to the developer case.

10. The image forming device as in claim 9, wherein the pushing member comprises a first pushing member that pushes the movement member in a first direction, and the first direction is a direction where the developing roller presses the photoreceptor.

11. The image forming device as in claim 9, wherein the pushing member comprises a second pushing member that pushes the movement member in a second direction, and the second direction is a direction where the developing roller separates from the photoreceptor.

12. The image forming device as in claim 9, wherein the pushing member comprises a first pushing member that pushes the movement member in a first direction, and a second pushing member that pushes the movement member in a second direction, the first direction is a direction where the developing roller presses the photoreceptor, the second direction is a direction where the developing roller separates from the photoreceptor.

13. The image forming device as in claim 12, wherein the first pushing member pushes a first area of the movement member, the second pushing member pushes a second area of the movement member, and the first area is different from the second area.

14. An image forming device, comprising:

an image forming device main body; and a developing unit detachably attached to the image forming device main body, wherein the image forming device main body comprises:

a casing comprising a space for housing the developing unit;

a photoreceptor disposed at a position facing the space; and a pushing member, wherein the developing unit comprises:

a developer case that accommodates a developer;

a developing roller coupled with the developer case, the developing roller being configured to supply the developer accommodated in the developer case to the photoreceptor; and a movement member coupled with the developer case, the movement member being configured to move between a housing position where the movement member is substantially housed inside the developer case and a protruding position where the movement member protrudes beyond the developer case, wherein in a process where the developing unit is attached to the image forming device main body, the movement member moves from the housing position to the protruding position, in a process where the developing unit is detached from the image forming device main body, the movement member moves from the protruding position to the housing position, the pushing member pushes the movement member in a predetermined direction while the developing unit is being housed in the casing, the developer case comprises a long hole, the movement member comprises a protruding portion that protrudes beyond the developer case via the long hole, the movement member is positioned at the housing position when the protruding portion is positioned at a first position with respect to the long hole, the movement member is positioned at the protruding position when the protruding portion is positioned at a second position with respect to the long hole, in a process where the developing unit is attached to the image forming device main body, the image forming device main body makes contact with the protruding portion, and the protruding portion is guided from the first position to the second position, and in a process where the developing unit is detached from the image forming device main body, the image forming device main body makes contact with the protruding portion, and the protruding portion is guided from the second position to the first position.

15. The image forming device as in claim 14, wherein the pushing member comprises a first pushing member that pushes the movement member in a first direction, and the first direction is a direction where the developing roller presses the photoreceptor.

16. The image forming device as in claim 14, wherein the pushing member comprises a second pushing member that pushes the movement member in a second direction, and the second direction is a direction where the developing roller separates from the photoreceptor.

17. The image forming device as in claim 14, wherein the pushing member comprises a first pushing member that pushes the movement member in a direction, and a second pushing member that pushes the movement member in a second direction, the first direction is a direction where the developing roller presses the photoreceptor, the second direction is a direction where the developing roller separates from the photoreceptor.

18. The image forming device as in claim 17, wherein the first pushing member pushes a first area of the movement member, the second pushing member pushes a second area of the movement member, and the first area is different from the second area.

* * * * *